US010907411B2

(12) United States Patent
Klam et al.

(10) Patent No.: US 10,907,411 B2
(45) Date of Patent: Feb. 2, 2021

(54) TOOL ASSEMBLY AND PROCESS FOR DRILLING BRANCHED OR MULTILATERAL WELLS WITH WHIP-STOCK

(71) Applicant: Modern Wellbore Solutions Ltd., Chestermere (CA)

(72) Inventors: Kyle Klam, Chestermere (CA); John Lewis Chute, Calgary (CA)

(73) Assignee: Modern Wellbore Solutions Ltd., Calgary (CA)

( * ) Notice: Subject to any disclaimer, the term of this patent is extended or adjusted under 35 U.S.C. 154(b) by 0 days.

(21) Appl. No.: 16/063,631

(22) PCT Filed: Dec. 16, 2016

(86) PCT No.: PCT/CA2016/051497

§ 371 (c)(1),
(2) Date: Jun. 18, 2018

(87) PCT Pub. No.: WO2017/100939

PCT Pub. Date: Jun. 22, 2017

(65) Prior Publication Data

US 2019/0003258 A1 Jan. 3, 2019

Related U.S. Application Data

(60) Provisional application No. 62/269,862, filed on Dec. 18, 2015.

(30) Foreign Application Priority Data

Dec. 18, 2015 (CA) ..... 2915624

(51) Int. Cl.
*E21B 7/06* (2006.01)
*E21B 34/10* (2006.01)
(Continued)

(52) U.S. Cl.
CPC ..... *E21B 7/061* (2013.01); *E21B 34/102* (2013.01); *E21B 34/14* (2013.01);
(Continued)

(58) Field of Classification Search
CPC ..... E21B 7/061; E21B 34/102; E21B 34/14; E21B 41/0035; E21B 43/26
See application file for complete search history.

(56) References Cited

U.S. PATENT DOCUMENTS 5,318,121 A * 6/1994 Brockman ..... E21B 7/061 166/313
5,787,978 A 8/1998 Carter et al.
(Continued)

FOREIGN PATENT DOCUMENTS

AU 2010274656 B2 1/2011
CA 2639294 C 7/2009
(Continued)

OTHER PUBLICATIONS

Canadian Intellectual Property Office, International Search Report for the International Application No. PCT/CA2016/051497 entitled "Tool Assembly and Process for Drilling Branched or Multilateral Wells with Whipstock", dated Jan. 12, 2017, 9 pages, Gatineau, Quebec, Canada.

(Continued)

*Primary Examiner* — Matthew R Buck
(74) *Attorney, Agent, or Firm* — Fasken Martineau DuMoulin LLP

(57) ABSTRACT

Downhole tool assembly comprises a whipstock engageable with a flow control device. The whipstock comprises a channel. A core is removably mounted in the channel. The flow control device comprises a valve with a shiftable sleeve for selectively directing fluid flow. In a process of drilling and operating a branched well, the whipstock is anchored at
(Continued)

a junction in a first well. A second well is drilled from the junction in a direction defined by the work face of the whipstock. After drilling, the core is removed to open the channel in the whipstock. The valve can be set to direct fluid flow to the second well so a fluid pressure can be applied to the second well. The valve can also be set to direct fluid flow through the channel to the first well, so a fluid pressure can be applied to the first well.

29 Claims, 22 Drawing Sheets

(51) Int. Cl.

| | |
|---|---|
| ***E21B 34/14*** | (2006.01) |
| ***E21B 43/26*** | (2006.01) |
| ***E21B 41/00*** | (2006.01) |
| *E21B 43/14* | (2006.01) |

(52) U.S. Cl.
CPC ..... *E21B 41/0035* (2013.01); *E21B 43/26* (2013.01); *E21B 43/14* (2013.01); *E21B 2200/06* (2020.05)

(56) References Cited

U.S. PATENT DOCUMENTS

| | | | | |
|---|---|---|---|---|
| 5,845,707 | A * | 12/1998 | Longbottom | E21B 7/061 166/50 |
| 6,019,173 | A | 2/2000 | Saurer et al. | |
| 6,053,254 | A * | 4/2000 | Gano | E21B 41/0035 166/117.6 |
| 6,119,771 | A * | 9/2000 | Gano | E21B 41/0042 166/50 |
| 6,209,644 | B1 | 3/2001 | Brunet | |
| 6,732,802 | B2 * | 5/2004 | Smith | E21B 33/14 166/313 |
| 7,353,867 | B2 | 4/2008 | Carter et al. | |
| 7,669,664 | B2 | 3/2010 | McGarian et al. | |
| 8,220,547 | B2 | 7/2012 | Craig et al. | |
| 8,393,392 | B2 | 3/2013 | Mytopher et al. | |
| 8,950,509 | B2 | 2/2015 | Coffey et al. | |
| 9,416,638 | B2 * | 8/2016 | Zhou | E21B 43/12 |
| 9,441,466 | B2 | 9/2016 | Coffey et al. | |
| 9,664,013 | B2 | 5/2017 | Coffey et al. | |
| 9,945,214 | B2 | 4/2018 | Coffey et al. | |
| 10,125,574 | B2 | 11/2018 | Arabsky et al. | |
| 10,167,711 | B2 | 1/2019 | Arabsky et al. | |
| 10,233,725 | B2 | 3/2019 | Provost | |
| 10,323,493 | B2 | 6/2019 | Randall | |
| 10,344,560 | B2 | 7/2019 | Arabsky et al. | |
| 2017/0101851 | A1 | 4/2017 | Arabsky et al. | |
| 2018/0038209 | A1 | 2/2018 | Coffey et al. | |
| 2018/0252075 | A1 | 9/2018 | Dietz | |
| 2018/0274330 | A1 | 9/2018 | Sim et al. | |
| 2018/0355690 | A1 | 12/2018 | Hern et al. | |
| 2019/0040716 | A1 | 2/2019 | Arabsky | |
| 2019/0048716 | A1 | 2/2019 | Perry et al. | |
| 2019/0128097 | A1 | 5/2019 | Arabskyy | |
| 2019/0136631 | A1 | 5/2019 | Hogan | |
| 2019/0136682 | A1 | 5/2019 | Benson et al. | |
| 2019/0145173 | A1 | 5/2019 | Hornblower et al. | |
| 2019/0169974 | A1 | 6/2019 | Melo Uribe et al. | |
| 2019/0169984 | A1 | 6/2019 | Smart et al. | |
| 2019/0218888 | A1 | 7/2019 | Bacsik et al. | |

FOREIGN PATENT DOCUMENTS

| | | | |
|---|---|---|---|
| CA | 2871622 | A1 | 1/2016 |
| CA | 3053667 | A1 | 8/2018 |
| WO | 2017200945 | A1 | 11/2017 |
| WO | 2018/152615 | A1 | 8/2018 |
| WO | 2018/184093 | A1 | 10/2018 |
| WO | 2019025761 | A2 | 2/2019 |

OTHER PUBLICATIONS

Canadian Intellectual Property Office, Written Opinion of the International Searching Authority for the International Application No. PCT/CA2016/051497 entitled "Tool Assembly and Process for Drilling Branched or Multilateral Wells with Whipstock", dated Jan. 12, 2017, 6 pages, Gatineau, Quebec, Canada.

* cited by examiner

TOOL ASSEMBLY AND PROCESS FOR DRILLING BRANCHED OR MULTILATERAL WELLS WITH WHIP-STOCK

CROSS-REFERENCE TO RELATED APPLICATIONS

This application is a National Stage submission under 37 U.S.C. § 371 of International Application No. PCT/CA2016/51497, filed Dec. 16, 2016, which claims the benefit and priority of Canadian Application No. 2,915,624 filed Dec. 18, 2015, and U.S. Provisional Application No. 62/269,862, filed Dec. 18, 2015, all of which are specifically incorporated by reference herein in their entirety.

RELATED APPLICATION

This Patent Cooperation Treaty Application claims the benefit under 35 USC § 119 (e) from U.S. Provisional Patent Application No. 62/269,862, filed on Dec. 18, 2015, which is incorporated by reference herein in its entirety. This Patent Cooperation Treaty Application also claims the benefit of Canadian patent application 2,915,624 filed on Dec. 18, 2015, which is incorporated by reference in its entirety.

FIELD

The present application relates generally to methods and tools for drilling branched or multilateral wells, particularly processes and tool assemblies for drilling branched or multilateral wells with a whipstock.

BACKGROUND

The following paragraphs are provided by way of background to the present disclosure. They are not however an admission that anything discussed therein is prior art or part of the knowledge of persons skilled in the art.

Multilateral wells have been used to extract hydrocarbon materials, such as oil or natural gas, from oil or gas reservoirs. Exploitation of oil and gas reserves can be improved by using wells with one or more branches or lateral wells. Additional lateral wells can provide a viable approach to improving productivity and recovery efficiency while reducing overall development costs. According to a report (https://www.slb.com/~/media/Files/resources/oilfield_review/ors98/win98/key.pdf), a multilateral well was first tested in 1953 in the Bashkiria Field near Bashkortostan, Russia, which had a main wellbore and nine lateral branches. It was reported that this well arrangement increased exposure to pay by 5.5 times and production by 17 fold, but the cost was only about 1.5 times the cost for drilling and operating a well with a single wellbore under the same conditions.

Typically, a production packer with a mechanical plug is set at a junction in the main wellbore in a multilateral well above a first (lower) leg to isolate the lower leg while a second (higher) leg is drilled from the junction. A junction is the location in a multilateral well where a lateral section (usually horizontal) intersects the main wellbore (usually vertical). After running a liner in the second leg, the completion can be run. If leg isolation is required, a flow sleeve can be installed at the junction to allow selected stimulation or production as required. Re-entry into both legs is possible by use of a selective system. For example, a known technique for drilling a lateral or branch well from a main wellbore involves the use of a device known as a whipstock, which provides an angled work face to orient the drill for drilling the lateral well at the branching junction. The whipstock also functions as a plug to isolate the lower portion of the main wellbore and any lower branch(es) while drilling the new branch or lateral well. After the second or new lateral well has been drilled, the whipstock may be removed or partially destroyed (such as drilled through or melted) to provide an opening for accessing the main wellbore below the branching junction. It is also known to provide a valve regulated fluid channel in the whipstock to allow fluid access. With the use of a whipstock, a multilateral well may be conveniently drilled and operated.

Example uses of multilateral wells include multistage fracturing through a multilateral well. Such a technique may involve the use of a ball drop sleeve system in each lateral well to selectively fracture different segments of a hydrocarbon reservoir. Such a technique allows sequential application of fracturing fluids at different sections of a horizontal wellbore in stages. It is expected that this technique might make it possible to more economically extract oil or gas from less permeable, or "tighter", rock formations, which might be otherwise uneconomical to exploit with another conventional extraction technology. However, conventional horizontal multistage fracturing techniques for single wells have been less successful when they were applied to multilateral wells, in part due to the costs and complexities associated with the construction of the junction.

For example, in some known methods of constructing multilateral wells for multistage fracturing, it is necessary to install through tubing lateral deflectors downhole. Such a technology requires the use of a well casing with increased size, and consequently increased drilling time and drilling cost. Further, during installation and removal of the deflectors, the fracturing crew cannot perform the fracturing operation, which results in costly downtime for the fracturing crew. Both of these factors lead to increased costs associated with well construction, and offset the potential benefits of using a multilateral well.

Further, in conventional drilling and fracturing techniques, drilling operation and fracturing operations may require different surface crews and rig set ups, and switching from drilling operation to fracturing operation, or vice versa, may require changing of surface crew and rig set up. With the use of a multilateral well, the drilling crew/rig and the fracturing crew/rig may need to be switched multiple times during the entire operation. Such multiple changes can also cause delay and increase costs.

SUMMARY

The following paragraphs are intended to introduce the reader to the more detailed description that follows and not to define or limit the claimed subject matter of the present disclosure.

In one broad aspect, in accordance with the teachings herein, there is provided a downhole tool assembly for drilling and operating a branched well, comprising a whipstock comprising a whipstock body having a channel defined therethrough and comprising a first coupling structure, and a core that is removably mounted in the channel, the core having a work face for orienting a drill to drill the branched well; and a flow control device comprising a second coupling structure for coupling with the first coupling structure to engage the whipstock body, and a valve comprising a shiftable sleeve for selectively directing fluid flow to the branched well or to the channel in the whipstock body when the first and second coupling structures are coupled to each other.

In at least one embodiment, the valve can be a ball-actuated valve and comprises a tubular body defining a conduit connecting an input port to a first output port and a second output port, wherein the second output port is configured to be in flow communication with the channel in the whipstock body when the first and second coupling structures are coupled to each other, wherein the shiftable sleeve is mounted in the conduit and is actuatable by a drop ball where the sleeve moves from a first position covering the second output port to a second position away from the first position to open the second port, a ball seat connected to the sleeve for receiving and holding the drop ball therein, wherein when the drop ball sits in the ball seat the input port is isolated from the first output port.

In at least one embodiment, the conduit can be defined by a wall of the tubular body extending between the input port and the first output port, and the second output port comprises an opening in the wall.

In at least one embodiment, the ball-actuated valve can comprise a locking and releasing structure configured to lock the sleeve in the first position when the sleeve is biased by a pressure below a selected threshold pressure, and to release the sleeve to allow it to slide to the second position when the sleeve is biased by a pressure above the selected threshold pressure.

In at least one embodiment, the first coupling structure can comprise a groove, and the second coupling structure can comprise a rail that is receivable in the groove.

In at least one embodiment, the groove can be covered by the core when the core is mounted in the channel.

In at least one embodiment, the core can be secured in place in the channel by a pin received in a pin hole in the whipstock body, the pin being breakable by application of a shearing force to release the core from the whipstock body.

In at least one embodiment, the channel can be configured and sized to allow drop balls of a ball drop system to pass therethrough.

In at least one embodiment, the whipstock body and the flow control device can be configured to seal a contact surface therebetween when the first and second coupling structures are coupled to each other.

In at least one embodiment, the valve can be configured to receive a bridge plug, a control line, or a shifting tool for shifting the sleeve. The bridge plug, control line, or shifting tool can be operable by a wireline, a slickline, a coiled tubing or a rig.

In a further aspect, in accordance with the teachings herein, there is provided a process of drilling and operating a branched well in a reservoir of hydrocarbons. The process comprises (a) anchoring a whipstock of an assembly as described herein at a junction in a first well, and drilling a second well from the junction in a direction defined at least in part by the work face of the whipstock; (b) removing the core from the whipstock body to open a channel in the whipstock body; (c) coupling a flow control device of the assembly to the whipstock; (d) setting a valve to direct fluid flow to the second well, and applying a first fluid pressure to the second well through the flow control device; and (e) setting the valve to direct fluid flow to the channel in the whipstock body, and applying a second fluid pressure to the first well through the flow control device and the channel in the whipstock body.

In the process described above, actions in (e) may be performed after actions in (d).

In the process described above, the valve can be a ball-actuated valve and setting the valve in action (e) can comprise flowing a drop ball into the flow control device to re-direct fluid flow.

In the process described above, a first liner system can be installed in the first well before action (a), and a second liner system in the second well can be installed before action (b).

In the process describe above, at least one of the first and second liner systems can comprise a ball drop liner system.

At least one of the liner systems can comprise a cemented liner (plug and perf) liner system, a cemented liner with ports (coiled tubing fracturing system) liner system, an open hole mechanical or swellable packers with ports between packers liner system, or an open hole mechanical or swellable packers and perforations between packers liner system.

Each of the first and second liner systems can comprise a ball drop liner system and each of the first and second liner system can comprise a cemented liner (plug and perf) liner system, a cemented liner with ports (coiled tubing fracturing system) liner system, an open hole mechanical or swellable packers with ports between packers liner system, or an open hole mechanical or swellable packers and perforations between packers liner system.

The process can comprise drilling the first well.

The process can include injecting a fracturing fluid into each one of the first well and the second well at a pressure sufficient to fracture a portion of the reservoir around the each well.

The process can comprise performing a multistage fracturing operation in each one of the first and second wells.

The whipstock can be supported on a packer device mounted in the first well below the junction.

The process can comprise injecting a stimulation fluid into each one of the first and second wells at a pressure sufficient to stimulate a portion of the reservoir around each well.

The first well can have a substantially vertical section.

The first well can have a substantially horizontal section.

Other aspects, features, and embodiments of the present disclosure will become apparent to those of ordinary skill in the art upon review of the following description of specific example embodiments in conjunction with the accompanying figures. It should be understood, however, that the detailed description, while indicating preferred implementations of the present disclosure, are given by way of illustration only, since various changes and modifications within the spirit and scope of the disclosure will become apparent to those of skill in the art from the detailed description.

BRIEF DESCRIPTION OF THE DRAWINGS

The disclosure is in the hereinafter provided paragraphs described in relation to its figures. The figures provided herein are provided for illustration purposes and are not intended to limit the present disclosure. Like numerals designate like or similar features throughout the several views, possibly shown situated differently or from a different angle. Thus, by way of example only, part 202 in FIG. 2C and FIG. 2D refers to a workface of a whipstock in both of these figures.

In the figures, which illustrate, by way of example only, embodiments of the present disclosure.

Figure 1A:
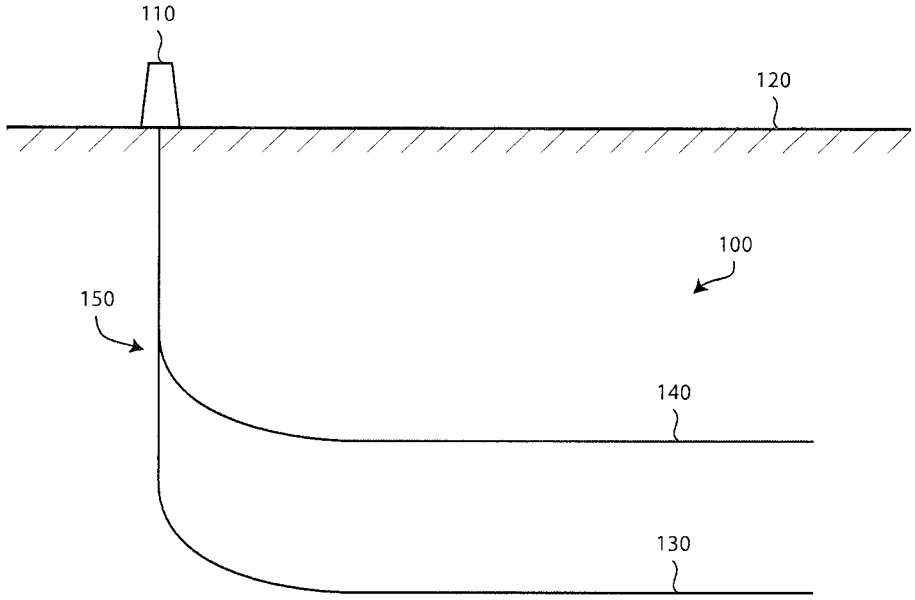
FIGS. 1A, 1B and 1C are schematic views of different arrangements of multilateral wells in a reservoir.

The figures together with the following detailed description make apparent to those skilled in the art how the disclosure may be implemented in practice.

DETAILED DESCRIPTION

Various apparatuses and processes will be described below to provide an example of an embodiment of each claimed subject matter. No embodiment described below limits any claimed subject matter and any claimed subject matter may cover any apparatuses, assemblies, methods, processes, or systems that differ from those described below. The claimed subject matter is not limited to any apparatuses, assemblies, methods, processes, or systems having all of the features of any apparatuses, assemblies, methods, processes, or systems described below or to features common to multiple or all of the any apparatuses methods, processes, or systems below. It is possible that an apparatus, assembly, method, process, or system described below is not an embodiment of any claimed subject matter. Any subject matter disclosed in an apparatus, assembly, method, process, or system described below that is not claimed in this document may be the subject matter of another protective instrument, for example, a continuing patent application, and the applicants, inventors or owners do not intend to abandon, disclaim or dedicate to the public any such subject matter by its disclosure in this document.

All publications, patents, and patent applications are herein incorporated by reference in their entirety to the same extent as if each individual publication, patent or patent application was specifically and indicates to be incorporated by reference in its entirety.

Several directional terms such as "above", "below", "lower" and "upper" are used herein for convenience including for reference to the drawings. In general "up" "upper", "above", "upward" and "proximal" and similar terms are used to refer to a direction towards the earth's surface, while "lower", "below", "down", "downward" and "distal" refer to a direction generally away from the earth's surface along the wellbore. Furthermore in the Figures "U" signifies "up" and "D" signifies "down". The terms "horizontal", and "vertical" are generally used in reference to the earth's surface, i.e. horizontal is generally intended to mean substantially parallel to the earth's surface, while vertical is generally intended to mean substantially perpendicular to the earth's surface.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof. When a list of items is given herein with an "or" before the last item, any one of the listed items or any suitable combination of two or more of the listed items can be selected and used.

It will be understood that any range of values herein is intended to specifically include any intermediate value or sub-range within the given range, and all such intermediate values and sub-ranges are individually and specifically disclosed.

It will also be understood that the word "a" or "an" is intended to mean "one or more" or "at least one", and any singular form is intended to include plurals herein, unless expressly specified otherwise.

It will be further understood that the term "comprise", including any variation thereof, is intended to be open-ended and means "include, but not limited to", unless otherwise specifically indicated to the contrary.

In overview, it has been realized that a whipstock assembly can be configured to provide selective access to different branches of a branched well, and, the flow path can be conveniently controlled with a shiftable valve coupled to a whipstock having a flow channel. In one embodiment, the shiftable valve is a ball actuated valve. The ball-actuated valve can be conveniently operated using a drop ball used in a typical ball drop liner system for fracturing operations. Thus, conveniently, branched wells, including multilateral wells, can be drilled and subjected to fracturing operation with reduced change-over of the service rigs or crews at the surface, thus reducing operation time and costs.

In an embodiment, a downhole tool assembly for drilling and operating a branched well is provided. The assembly includes a whipstock and a shiftable flow control device. The assembly can also include a packer device for supporting and anchoring the whipstock. The whipstock has a body with a channel defined therethrough. A coupling structure, such as a groove, is provided on the whipstock body. A core is removably mounted in the channel. The core has a work face for orienting a drill to drill the branched well. The flow control device includes a corresponding coupling structure, such as a rail, for coupling with the coupling structure on the whipstock body to engage the whipstock body. The flow control device can also include, in one embodiment, a ball-actuated valve for selectively directing fluid flow to the branched well or to the channel in the whipstock body when the whipstock body is coupled to the flow control device.

The core can also include a keyway or collar for engaging a retrieval tool to remove the core from the whipstock body. The core can be secured in place in the channel of the whipstock body by any suitable locking mechanism. For example, a shear pin can be provided for locking the core in place. The pin can be received in a pin hole in the whipstock body, and is breakable by a shearing force to release the core from the whipstock body. The channel of the whipstock body can be configured and sized to allow drop balls of a drop ball drop system to pass therethrough. The ball drop system can be a ball drop liner system suitable for performing multistage fracturing operations in a well.

The ball-actuated valve can include a tubular body defining a conduit connecting an input port to a first output port and a second output port. The second output port is configured to be in flow communication with the channel in the whipstock body when the whipstock body is coupled to the flow control device. A sleeve is mounted in the conduit and is actuatable by a drop ball, such as a drop ball used in a conventional ball drop liner system, so that the sleeve slides from a first position covering the second output port to a second position away from the first position to open the second output port. A ball seat is connected to the sleeve for receiving and holding the drop ball therein. When the drop ball sits in the ball seat, it isolates the input port from the first output port.

The conduit in the ball-actuated valve can be defined by a wall of the tubular body extending between the input port and the first output port, and the second output port can be an opening in the wall. The ball-actuated valve can include a locking and releasing structure configured to lock the sleeve in the first position when the sleeve is biased by a pressure below a threshold pressure, and to release the sleeve to allow it to slide to the second position when the sleeve is biased by a pressure above the threshold pressure.

The coupling structures can include a pair of groove and rail couplings. For example, the whipstock body can include one or more elongated grooves, which can function as rail guides, and the flow control device may include one or more matching rails receivable in the grooves to couple the flow control device to the whipstock body. The grooves can be covered by the core when the core is mounted in the channel.

Suitable sealing elements or structures can be provided to seal the contact surface between the whipstock body and the flow control device, so as to isolate the flow passageway defined by the whipstock and the flow control device from the surrounding environment or other fluid flows within a casing of the well.

A branched well in a reservoir of hydrocarbons can be drilled and operated conveniently with a whipstock assembly described herein. For example, in a selected process, a first well is drilled and the whipstock is anchored at a junction in the first well. The whipstock can be supported on a packer device mounted in the first well below the junction. A second well is drilled from the junction in a direction defined at least in part by the work face of the whipstock. After the second well is drilled and optionally conditioned, the core is removed from the whipstock body to open the channel in the whipstock body, and a matching flow control device as described herein is coupled to the whipstock body. The ball-actuated valve is initially set to direct fluid flow to the second well, so a fluid pressure can be applied to the second well through the flow control device to perform a desired operation in the second well, such as a multistage fracturing operation. After the operation in the second well is completed, a drop ball is flowed into the flow control device to actuate the ball-actuated valve to direct fluid flow to the channel in the whipstock body. At the same time, the drop ball can seal the flow path to the second well. Consequently, a fluid pressure can be applied to the first well through the flow control device and the channel in the whipstock body, without pressurizing the second well. A desired operation, such as a fracturing operation, can be then performed in the first well.

A liner system may be installed in each well. For example, a liner system may be installed in the first well before anchoring the whipstock, and a liner system may be installed in the second well after it has been drilled but before removing the whipstock core from the whipstock body. The liner systems can be ball drop liner systems known to those skilled in the art. The wells can be completed with cemented liners, and may be provided with coiled tubing.

Selected embodiments are described next with reference to the drawings.

FIG. 1A illustrates a typical multilateral well arrangement for fracturing an oil or gas reservoir 100. A rig, 110 is set up at surface 120 for drilling and operating wells 130 and 140. Rig 110 can be initially a drilling rig, and can be later replaced with a service rig, such as a fracturing rig, at a selected time. For simplicity, both types of rigs can be represented by rig 110.

Typically, a vertical well section, or the lower well 130 is first drilled, which can be referred to as the main well. Well 140 is drilled off the wellbore of well 130 at a branching junction 150. Ball drop systems can be installed in wells 130, 140, as will be further discussed below. A fracturing fluid is then applied to each well 130 or 140 through the ball drop systems to fracture portions of reservoir 100 around the wells 130, 140.

Figure 1B:
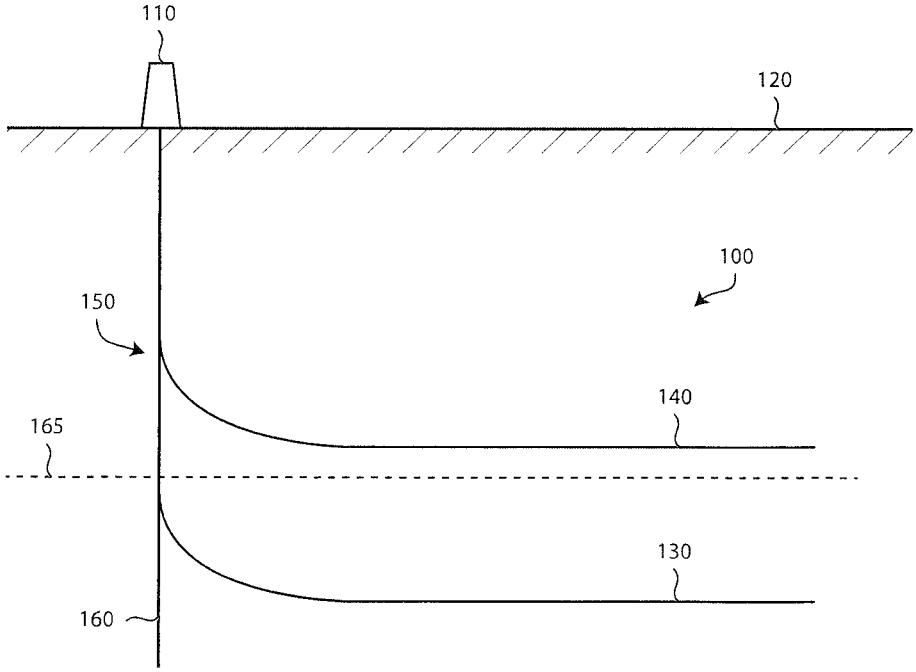

In an alternative arrangement, lateral wells 130 and 140 can be both drilled off a vertical main well 160 as illustrated in FIG. 1B. Vertical main well 160 can penetrate one or more layers of pay zone in reservoir 100, where the different layers of pay zone can be separated by an impermissible or semi-permissible barrier, such as barrier 165 as schematically depicted in FIG. 1B. In different embodiments, an upper well can be drilled before drilling a lower well. For example, wells 130 and 140 can be drilled in any order.

Figure 1C:
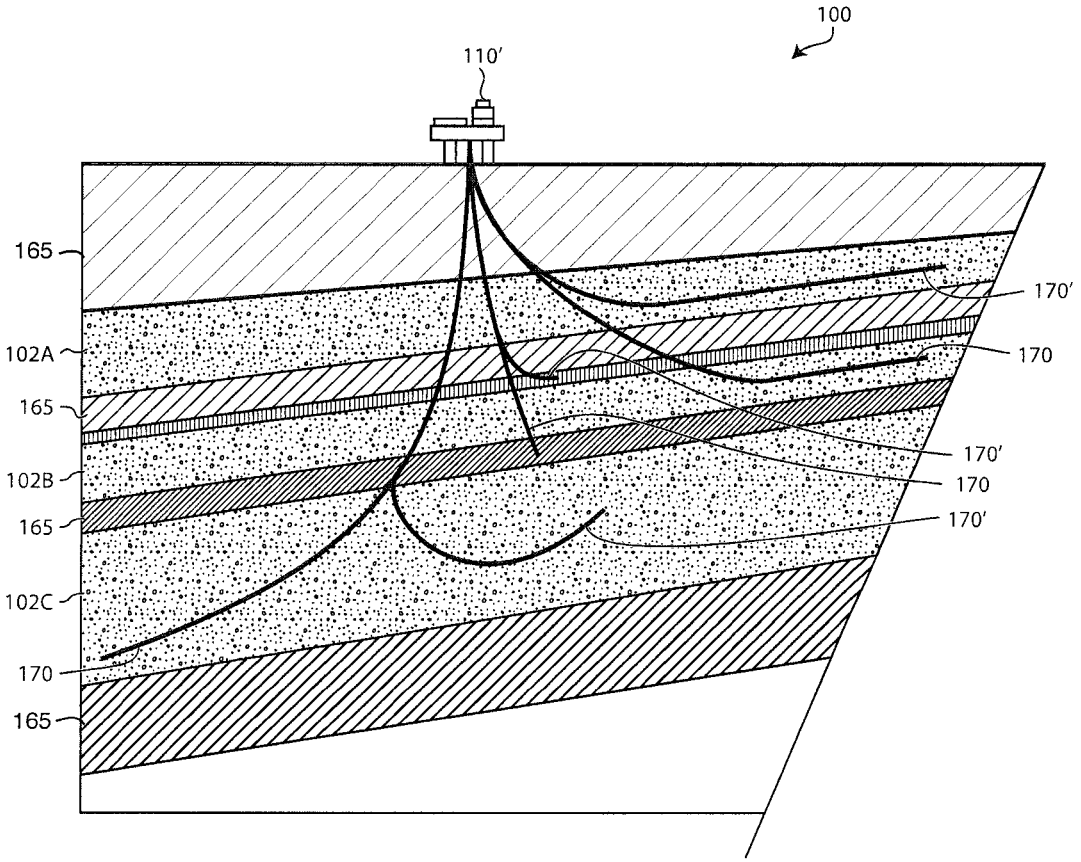

In another alternative arrangement, more than two lateral wells can be provided and the lateral wells may be oriented in different directions and at different vertical levels. For example, as illustrated in FIG. 1C, a well arrangement can include multiple wells 170 and 170' drilled from a single well pad or drill rig 110', which engage a number of stacked layers 102A, 102B, and 102C (also collectively referred to as 102) of pay zones in a formation of the reservoir 100. The different layers can be separated by barriers 165. The wells can include branched or lateral wells 170' that branch from main wells 170. As depicted, the different wells can be oriented in different directions and positioned at different vertical levels. One or more wells can extend generally horizontally. One or more wells can be inclined or extend generally vertically. Each separate formation or layer (e.g.

102A, 102B, or 102C) of pay zone can include one or more wells, and a single well can penetrate more than one formation or layer.

For simplicity of description, the following description of selected embodiments make references only to the well arrangement shown in FIG. 1A. It should be understood that the same or similar downhole equipment, tools and devices, and similar operations can be applied to other multilateral or branched well arrangements including, for example, the well arrangements illustrated in FIGS. 1B, and 1C and those described elsewhere herein.

According to an embodiment of the present disclosure, wells 130 and 140 can be drilled and operated as illustrated in FIGS. 2A to 2H.

Figure 2A:
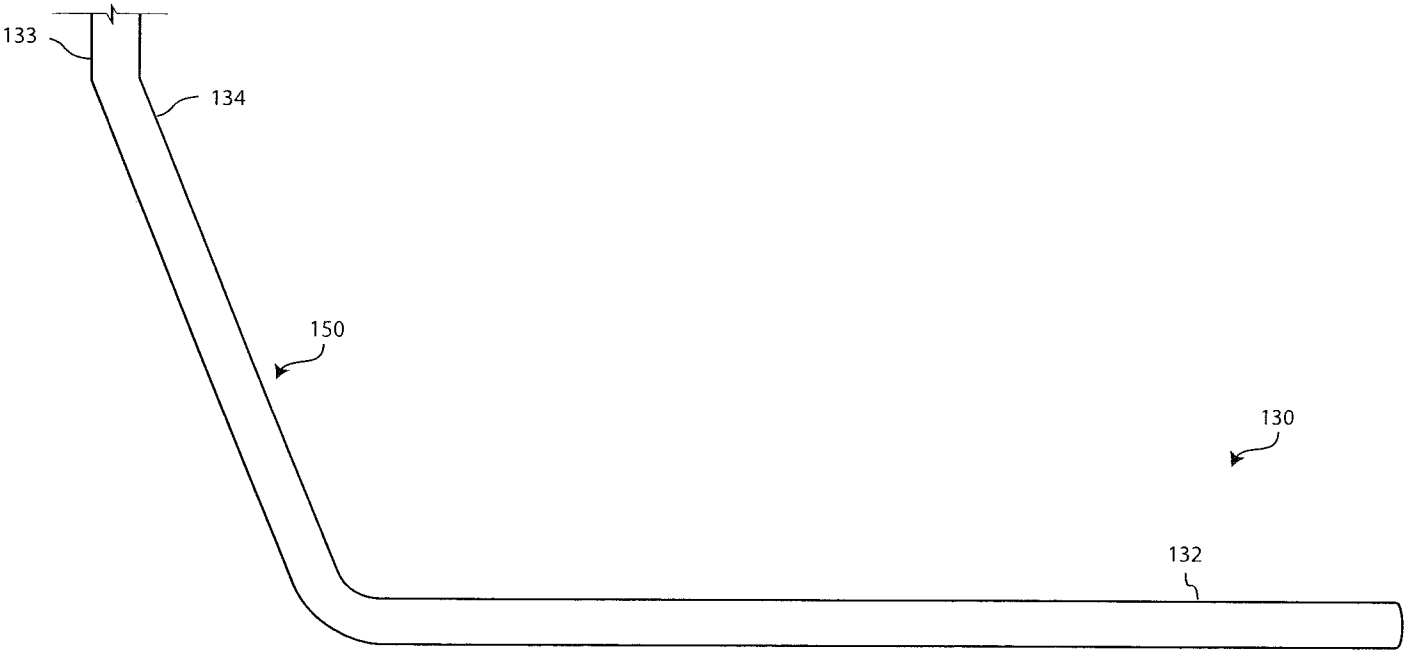
FIGS. 2A, 2B, 2C, 2D, 2E, 2F, 2G, 2H and 2I are schematic views, illustrating a process for drilling and operating the multilateral well of FIG. 1A, using a whipstock and a mating tool.

As depicted in FIG. 2A, the vertical portion 133 of the main well or well 130 can be first drilled out, cased and cemented. Next, in one embodiment, a tangent section 134 of well 130 can be drilled and optionally reamed, and can be partially completed. A tangent section can generally have an angle of, for example, about 5, 10, 15, 20, 25, 30, 35, 40, or 45 degrees relative to the substantially vertical section 133 of the well 130. For example, the tangent section 134 of well 130 can be completed with a casing (not shown); which, in one embodiment, can be 177.8 mm P-110 38.7 kg/m intermediate casing with long round thread (LTC). The casing can be cemented in place. Well 130 has a lateral section 132 extending from the tangent section 134. Lateral section 132, in one embodiment, can have a 156 mm diameter open hole, and can be generally horizontal. Tangent section 134 extends across the junction 150. The junction 150 is at the desired depth for drilling off well 140 (not shown in FIG. 2A; see: FIG. 2E-FIG. 2G). While not shown in FIG. 2A, it can be understood by those skilled in the art that a reamer (not shown) can be run in hole in well 130 to condition lateral section 132 for liner installation.

Figure 2B:
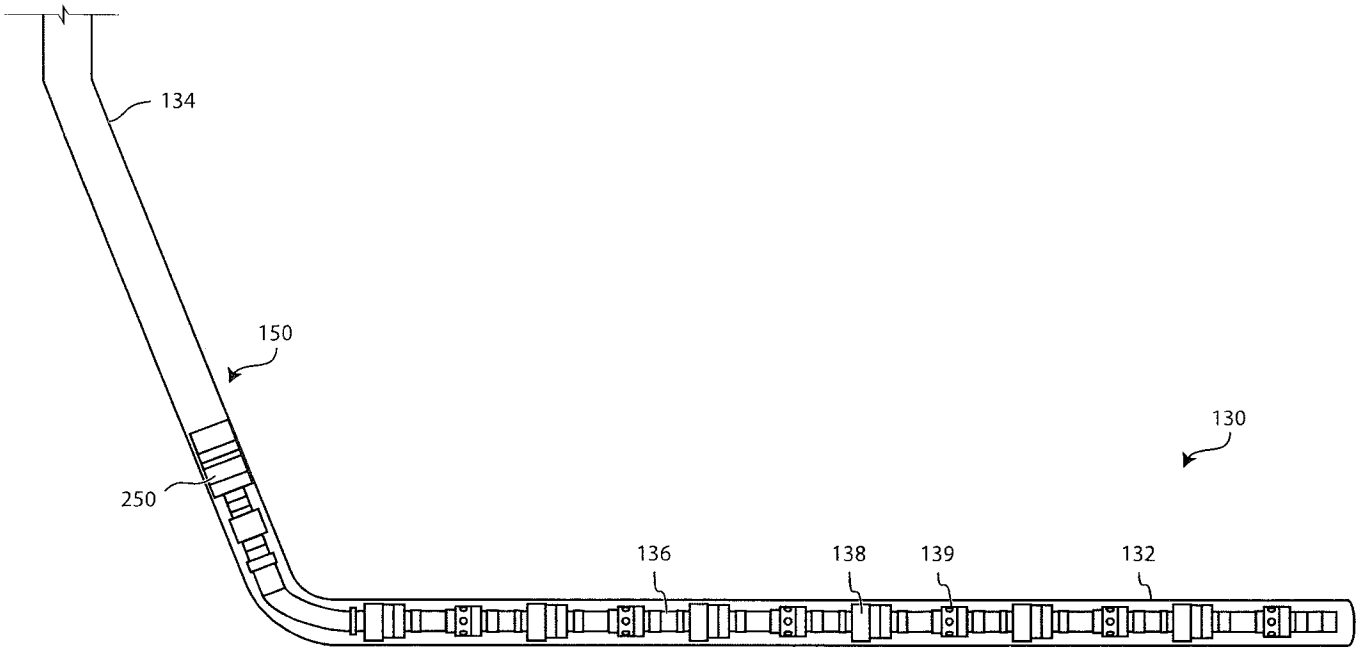

A liner system is next installed as shown in FIG. 2B. For example, a multistage ball drop system 136 can be installed in lateral section 132. The ball drop system 136 can be any suitable ball drop system as can be understood by those skilled in the art. For example, the ball drop system disclosed in U.S. Pat. No. 6,907,936 can be used.

In different embodiments, the ball drop system 136 can be modified or replaced with another suitable system, depending on the particular reservoir and the desired operation process. For example, liner systems suitable for multistage fracturing processes can be used including, a cemented liner (e.g. a plug and perf), a cemented liner with ports (e.g. a coiled tubing fracturing system), open hole mechanical or swellable packers with ports between packers, open hole mechanical or swellable packers and perforations between packers, or the like. Such liner systems can include mechanisms or devices to isolate the annulus of different wells in the formation being treated, such as by using packers or cement. Isolation packers can include one or more of mechanical, swellable, inflatable, resettable packers, or the like. Suitable cements can include one or more of acid soluble cement, highly viscous sand pills, bridging materials, Class G cement, or the like.

The liner system can optionally include open hole packers 138. The liner system can also optionally include a liner hanger packer, such as packer sub 250.

Other necessary and optional actions and operations can be taken or performed to prepare well 130 at this stage. For example, fluids and drilling or other materials can be circulated in or removed from well 130. In some embodiments, a fluid such as water-based mud can be injected in lateral section 132. Ball drop system 136 can be operated by delivering one or more drop balls down to a ball seat in a wellbore isolation valve (not shown) at the distal end of the system to build hydraulic pressure inside the ball drop system to set packers 138, according to conventional techniques and procedures. At this stage, the casing of well 130 can be pressure tested against liner hanger packers, according to conventional techniques and procedures.

Figure 2C:
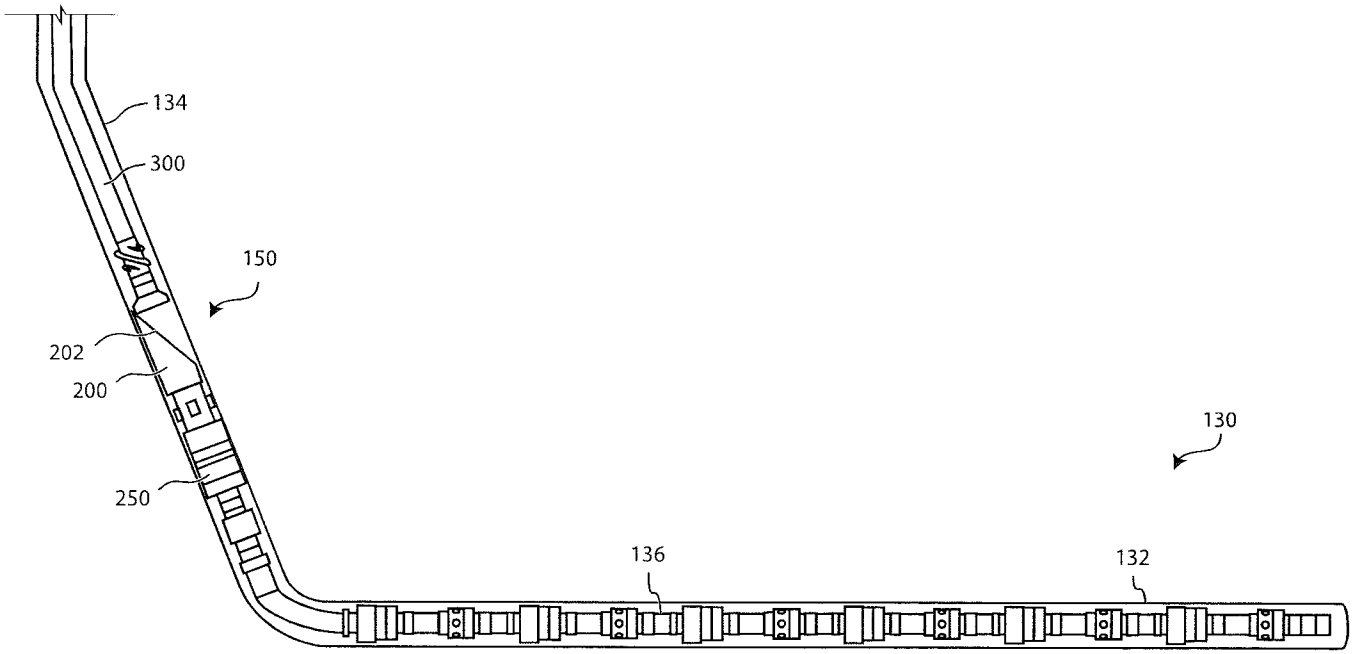

As depicted in FIG. 2C, after the liner system or ball drop system 136 is installed, a whipstock 200 is installed in well 130 and anchored at junction 150.

At this stage, a latch, stinger, or anchor (not shown) can be installed, where the latch can be a sealing or a non-sealing latch and can connect a tie back string (not shown) to the liner system or ball drop system 136. As is typical, a tubing string (not shown) can be installed in section 134, which can extend to a selected depth.

A debris sub or packer sub can also be provided. For example, as depicted in FIG. 2C, whipstock 200 is supported and connected to a packer sub 250 (which may also be referred to as a liner hanger packer).

The details of whipstock 200 and packer sub 250, and their installation and operation will be further described below (see: e.g. FIGS. 3A-7). Suffice it to note at this point that the work face 202 of whipstock 200 can be oriented downhole, for example, based on information obtained with a technique known as measurement while drilling (MWD), which is understood by those skilled in the art. Whipstock 200 includes a removable core 204 secured to the whipstock body by shear pins 206 (not shown in FIG. 2C, but see FIG. 3B). In some embodiments, the shear pins 206 can be replaced with a shear ring inside the body of whipstock 200, as can be understood by those skilled in the art.

Alternatively, once lowered to the selected depth in well 130, whipstock 200 can be oriented using a wireline gyro (not shown), and optionally with an orientation sub if the junction is in a vertical section of the well. For example, a gyro tool can be run through the drill pipe on a wireline, to engage a keyhole 208 (see FIG. 3D) of a known orientation in the whipstock 200. The drill string is next turned to a selected orientation to mechanically set the orientation of whipstock 200.

The packer sub 250 can include slips settable to mechanically lock the packer sub 250 in place and prevent it from rotating or moving up or down. The packer sub 250 also can include a sealing element that can provide a debris barrier.

While the packer sub 250 and whipstock 200 as depicted in the drawings can be set in place by a mechanical setting technique using weights of, for example, a downhole string such as a drill string, other alternative setting techniques can also be used to set packer sub 250 and whipstock 200. Such other setting techniques can include hydraulic setting techniques, setting with rotation and drag blocks, mechanical setting with an upward or downward pressure or force, setting with a wireline setting tool, or the like.

Figure 2D:
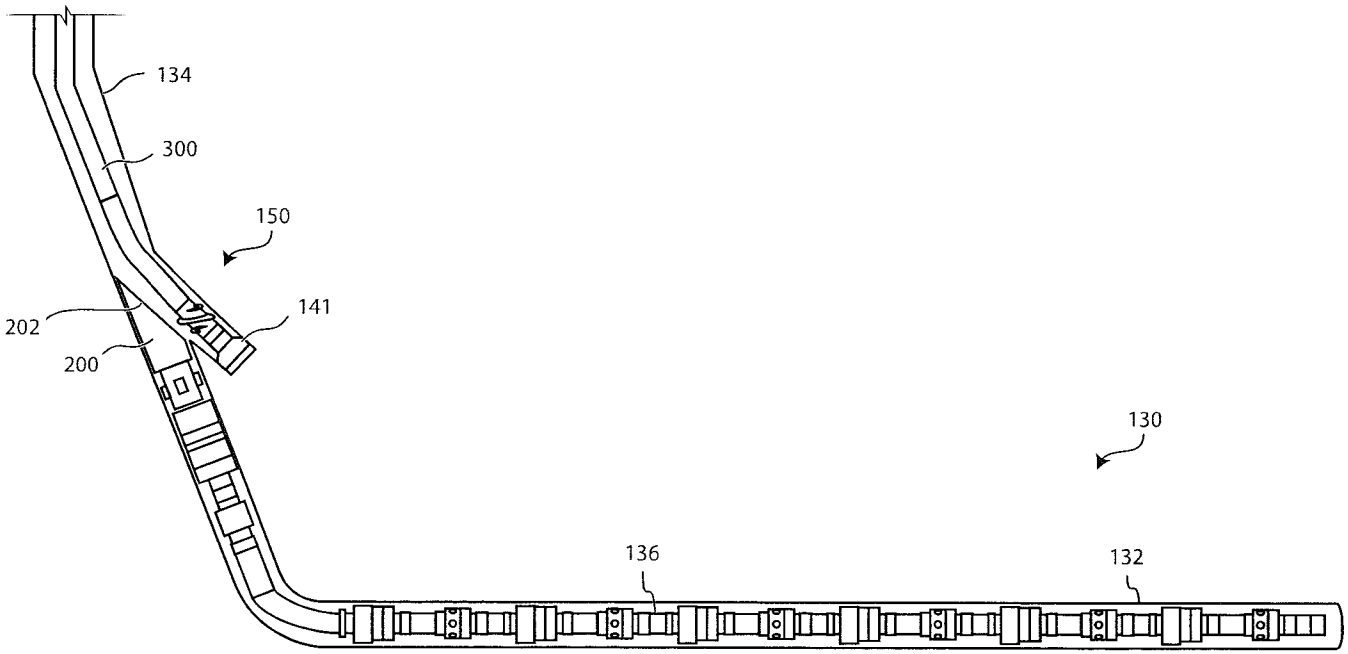
Figure 2E:
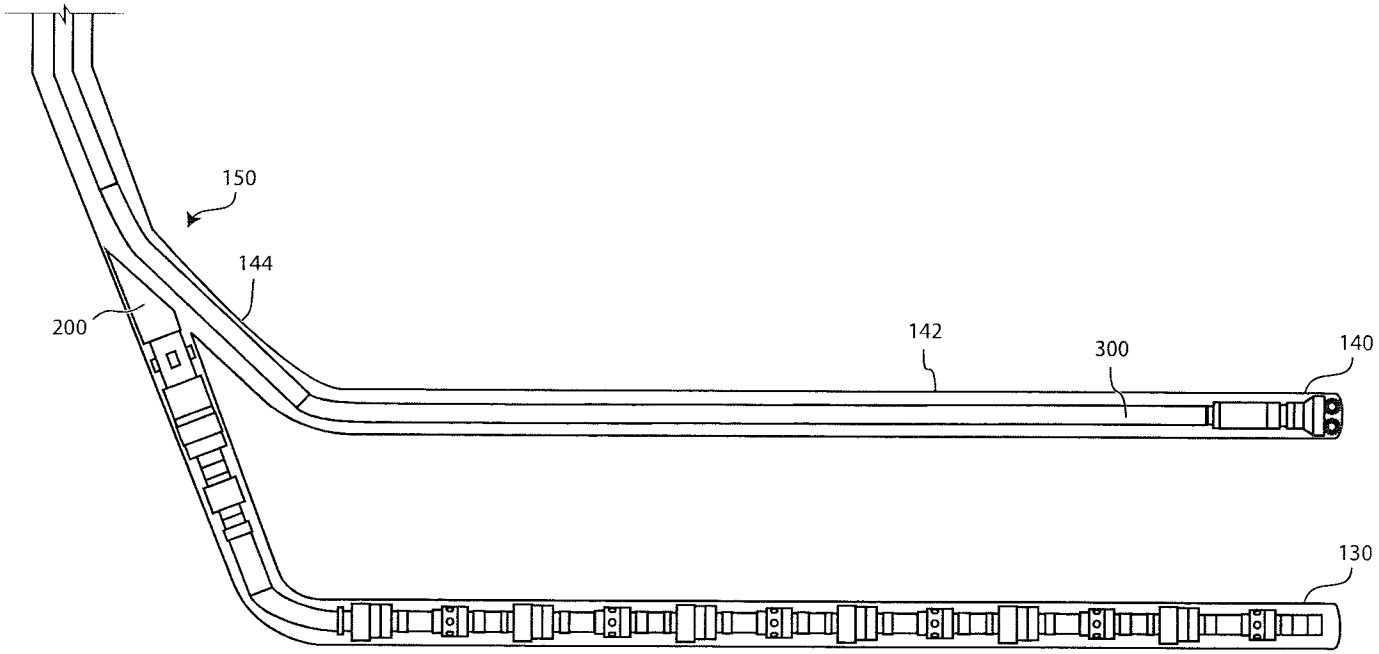
Figures 2F, 2G:
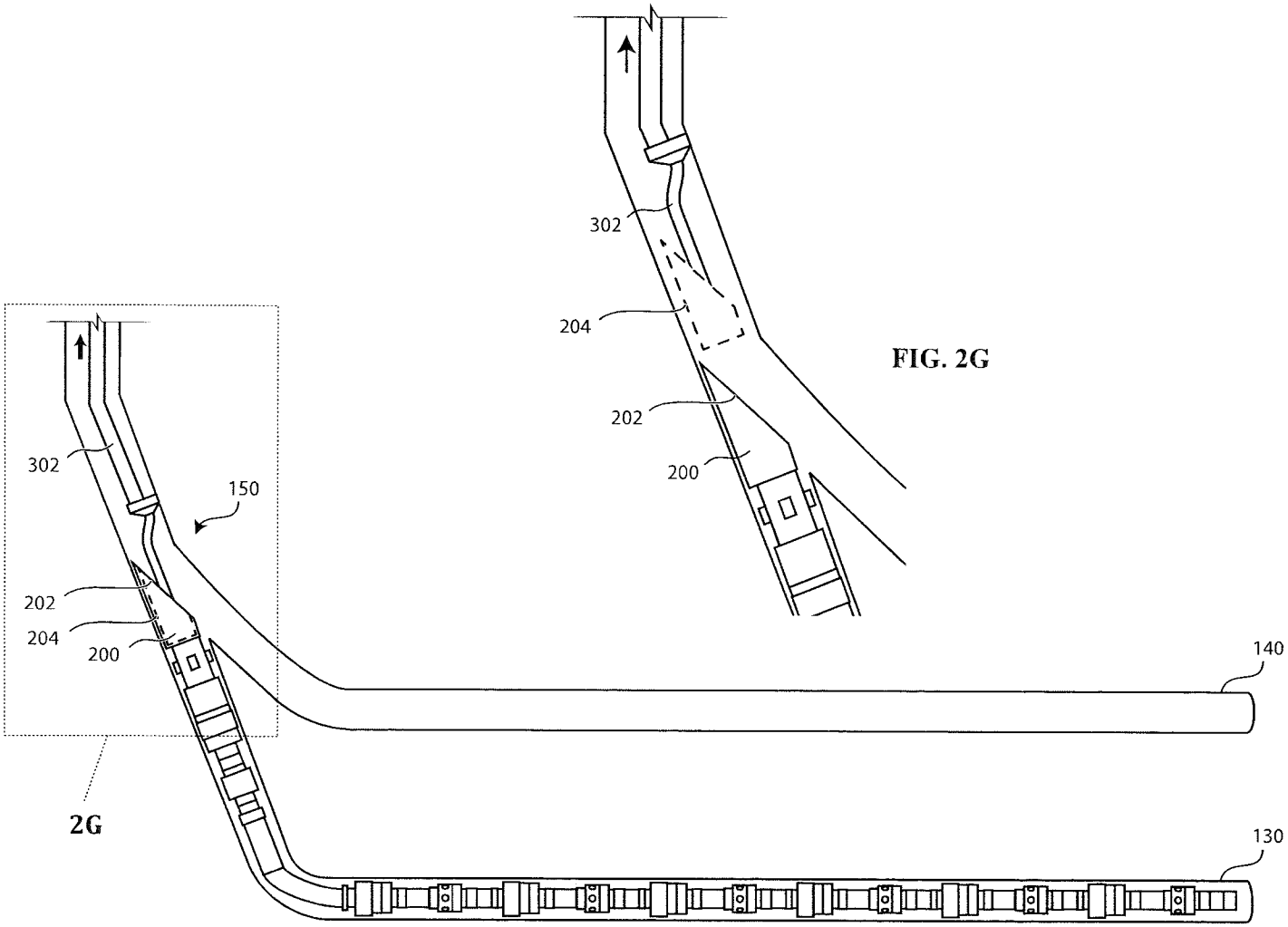

As illustrated in FIG. 2D, a drill string 300 is next run into well 130 and operated to mill a generally laterally facing window off the work face 202 of whipstock 200, and drill a, generally laterally diverted rathole 141 through a window at junction 150. The window can be milled with a mill bit. The initial direction of well 140, or the rathole 141, is set at least in part by work face 202 of whipstock 200.

In an embodiment, the window at junction 150 can be initially milled with a starter mill (not shown). The starter mill can be later successively replaced with progressively larger mills, for example watermelon mills (not shown). In some embodiments, the rathole 141 can have a length of about 15 m to about 20 m. After the rathole 141 has been drilled, the window milling assembly can be pulled out. The milling assembly can be examined or checked at the surface for gauge to ensure a full-bore window has been cut.

The milling bit or milling assembly can be replaced with a suitable drill bit or drilling assembly to continue to drill out the lateral well 140. Drilling is continued to complete drilling of well 140, as shown in FIG. 2E.

Known techniques of using a milling head with a whipstock to drill a branched or sidetracked well can be adopted. Such techniques can be found in, for example, in European Patent No. 2 018 463, PCT Patent Application No. WO 2006/070204, U.S. Pat. No. 6,056,056, and PCT Patent Application No. WO 1994/009243.

During the drilling of well 140, whipstock 200 can plug well 130 at junction 150 to prevent pressure and fluid communication between the upper and lower portions of well 130 that are above and below whipstock 200, respectively, thus isolating the upper and lower portions of well 130. Whipstock 200 can also function as a barrier to prevent debris or cuttings and other materials from falling down into the lower portion of well 130. Whipstock 200 further can function as a guide for guiding the drill string and, optionally, a reamer for drilling and reaming well 140, respectively.

As depicted in FIG. 2E, well 140 can have a generally horizontal lateral section 142 and an inclined section 144.

Lateral section 142 can be drilled and optionally reamed using conventional techniques and conventional directional tools, for example, standard bottom hole assembly (BHA) tools, including without limitation, drill pipe, jars, Monel non-magnetic collars, universal bottom hole orientation (UBHO) subs, float subs, bent housing and bits, as selected based on the requirement of a particular application.

As depicted in FIGS. 2F and 2G, after well 140 has been drilled and, optionally, reamed, the removable core 204 with work face 202 can be pulled out from whipstock 200 using a pulling tool 302 capable of engaging with the removable core 204, to open the fluid passageway to the lower portion of well 130 (as will be further described below). Before pulling the core 204 of whipstock 200, fluid circulation can be established above whipstock 200 to clean the fluid path above the core 204. Pulling tool 302 can include a fluid channel and a jet for injecting the fluid into junction 150 above whipstock 200. As can be appreciated, cleaning fluid can include a clean mud fluid.

As can be understood by those skilled in the art, whipstock 200 can include, in one embodiment, a keyway 208 (not shown in FIG. 2A-I; see: FIG. 3C) on the work face 202, and pulling tool 302 can include a hook (not shown) that can engage the keyway 208 to pull core 204 comprising work face 202. In case the hook of the pulling tool 302 fails to engage the keyway 208 in whipstock 200, an optional die collar retrieval tool (not shown) can be run in to engage work face 202, as an alternative to the pulling tool 302. The die collar retrieval tool can frictionally engage the external surface (work face 202) of core 204. Conventional pulling or retrieval tools with a hook, and die collar retrieval tools can be used, which can be readily implemented by those skilled in the art.

The head portion of pulling tool 302 can include a magnet, e.g. a rare earth magnet (not separately shown) and can be run past whipstock 200 into the inclined section 144 of well 140 to retrieve metal debris or other metal material with the magnet.

Before pulling the work face 202 and core 204 of whipstock 200, the shear pins 206 (see e.g. FIG. 3A-B) that can be used to secure the core 204 in place, in some embodiments, can first be sheared, such as by firing jars on the pulling tool 302 as will be understood by those skilled in the art. Once the shear pins 206 are sheared, core 204 with face 202 of whipstock 200 can be pulled out using the pulling tool 302. The wellbore area at or near junction 150 can be cleaned using, for example, viscous pills, as can be understood by those skilled in the art.

Figure 3A:
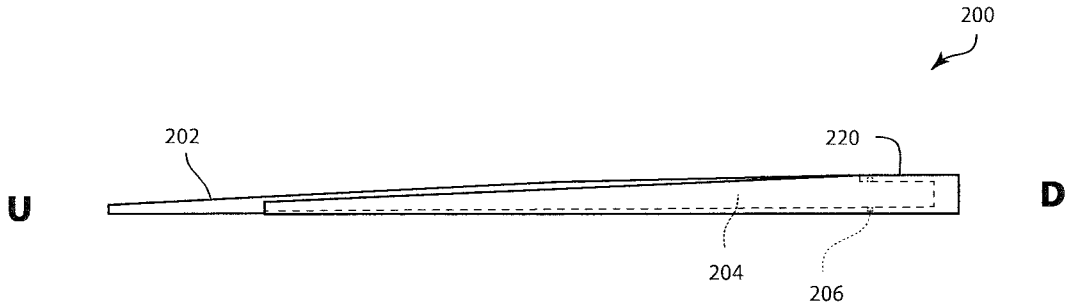
FIG. 3A is a side elevation view of a whipstock with a removable core.
Figure 3B:
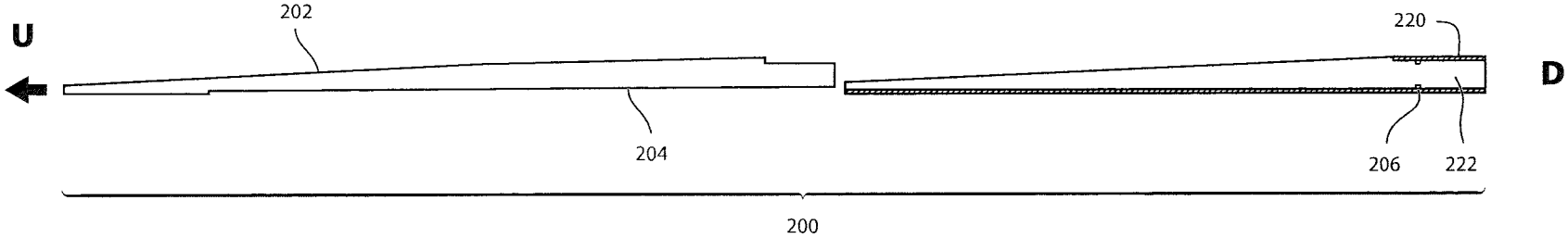
FIG. 3B is a cross-sectional view of the whipstock body of FIG. 3A, and an elevation view of the core removed from the whipstock body.
Figure 3D:
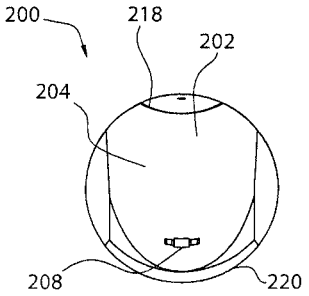
FIG. 3D is an uphole side elevation view of the whipstock of FIG. 3C as indicated by the letter U in FIGS. 3A and 3B.
Figure 3E:
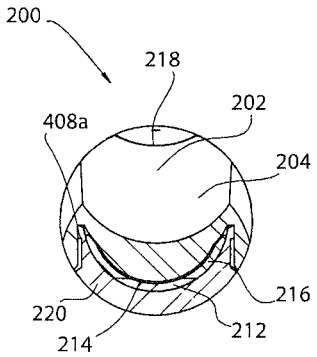
FIG. 3E is a cross-sectional view of the whipstock (with the core) of FIG. 3C, taken along line 3E-3E.
Figure 3C:
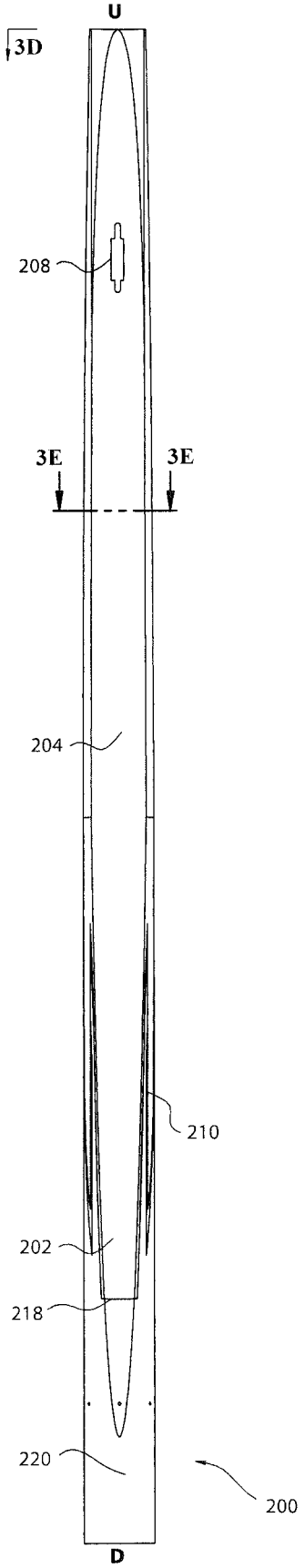
FIG. 3C is a top plan view of the whipstock of FIG. 3A, with the core in place.
Figure 3G:
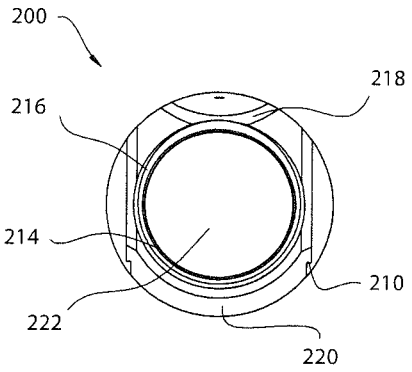
FIG. 3G is an uphole side elevation view of the whipstock body of FIG. 3F.
Figure 3H:
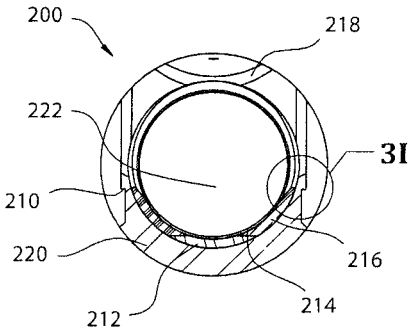
FIG. 3H is a cross-sectional view of the whipstock body (without the core) of FIG. 3F, taken along line 3H-3H.
Figure 3I:
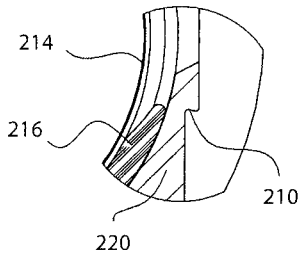
FIG. 3I is an enlarged cross-sectional view of the area marked 3I in FIG. 3H.
Figure 3F:
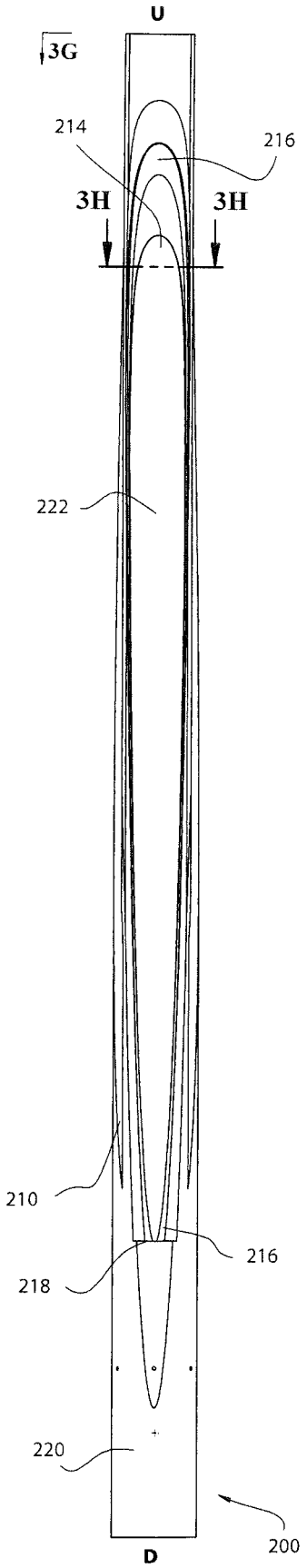
FIG. 3F is a top plan view of the whipstock body of FIG. 3B, with the core removed.

After core 204 of whipstock 200 is pulled out of the hole, rail guides 210 in whipstock 200, which are initially covered by work face 202, are now exposed (see e.g. FIG. 3F). Rail guides 210 can have the form of grooves.

Figure 2H:
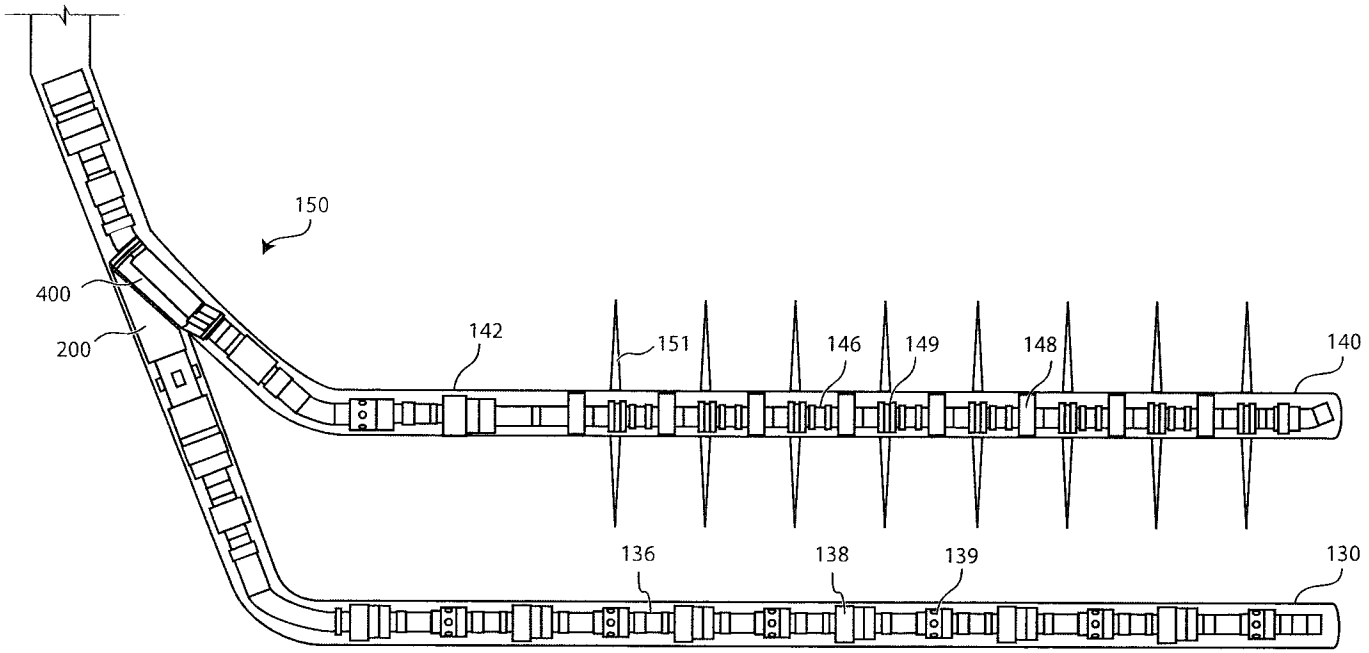

Next, a liner system can be run in hole into lateral section 142 as shown in FIG. 2H. The liner system can be used to convey fracturing fluids to the well and develop fractures 151 in the formation, facilitating the flow of hydrocarbon products.

A mating tool 400 is installed as part of liner system 146. When running the liner system 146 in the lateral section 142, sufficient piping or tubing can be run down hole so the mating tool 400 contacts the top of whipstock 200.

Mating tool 400 is directed, for example, by rotation to align rails 408*a* (see FIG. 3E or FIG. 4A) of mating tool 400 with rail guides 210 (see: e.g. FIG. 3F) on whipstock body 220. Rotation of mating tool 400 can be aided by guide fins 412*a* in the bottom fin sub 412 provided on mating tool 400, as will be further described below.

After mating tool 400 is correctly oriented, mating tool 400 is further lowered to allow the rails 408*a* to slide into, and engage, rail guides 210 of whipstock 200. The rail guides 210 and rails 408*a* provide a locking mechanism for locking the engagement of mating tool 400 to whipstock 200. This locking engagement can be detected at surface to indicate to the operator at surface that the mating tool 400 has been set in the correct position, for example by using a weight indicator capable of gauging string weight, and excess weight to indicate locking engagement.

Figure 4A:
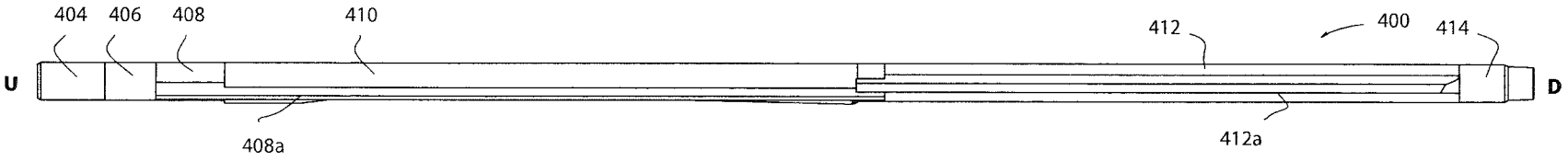
FIGS. 4A and 4B are a front elevation view and a bottom plan view of a mating tool, respectively.
Figure 4B:
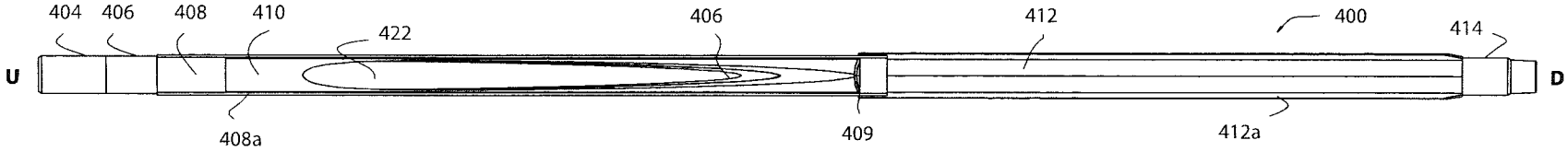
Figure 4C:
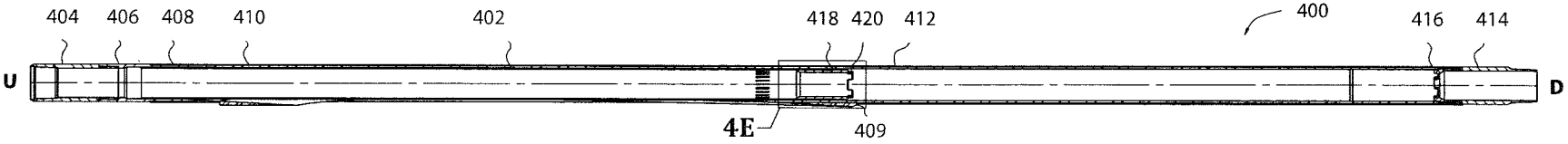
FIGS. 4C and 4D are cross-sectional views of the mating tool in different states.
Figure 4D:
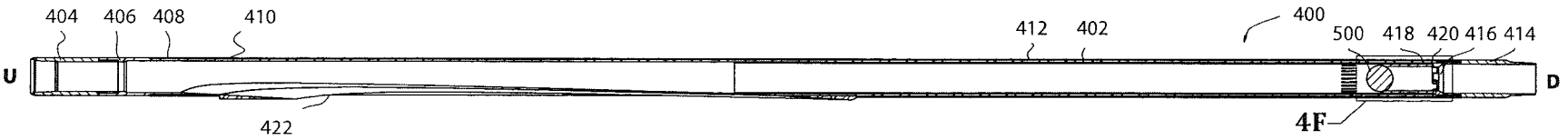
Figure 4E:
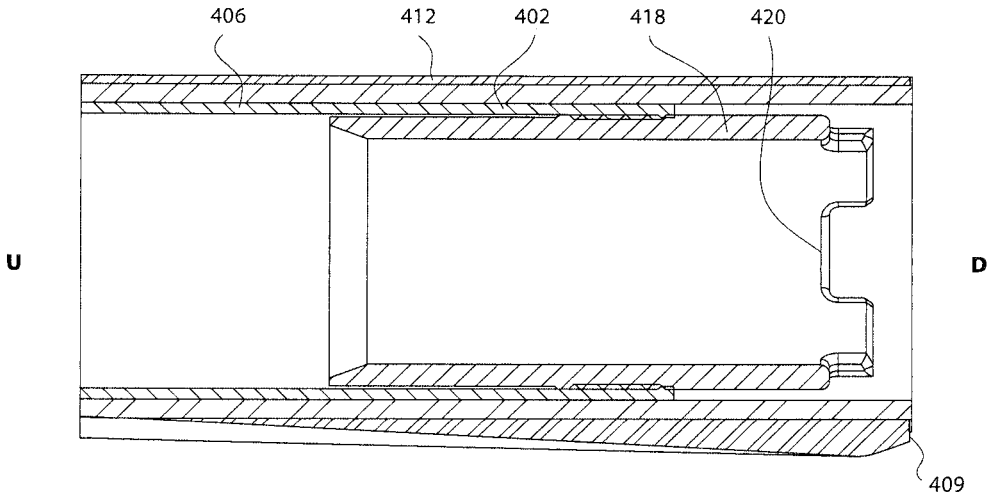
FIGS. 4E and 4F are enlarged cross-sectional views of the areas marked 4E in FIGS. 4C and 4F in FIG. 4D, respectively.
Figure 4F:
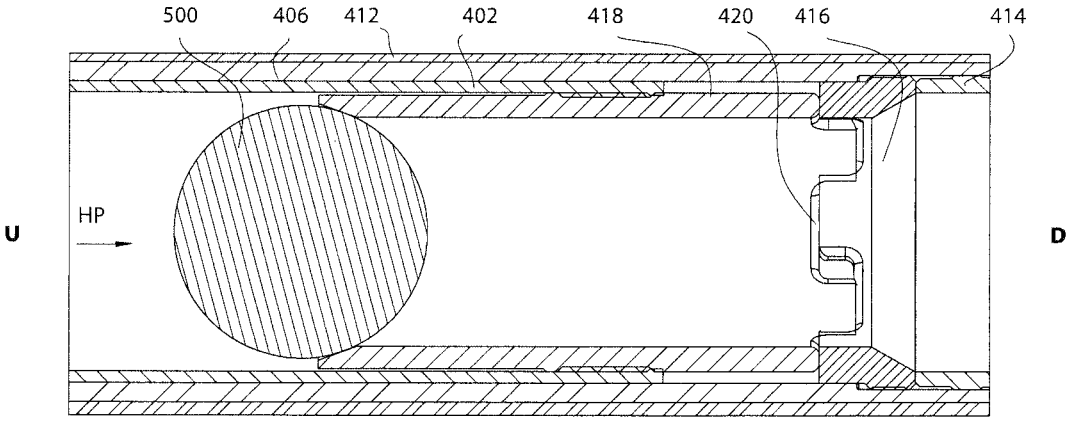

Mating tool 400 can comprise a ball drop sub 406 (see: FIG. 4A-B) for selectively directing fluid flow to well 140 or well 130. Initially, mating tool 400 is set to direct fluid flow towards well 140, and blocking the fluid path to the lower portion of well 130 through whipstock 200. After installation of ball drop system 146, a fluid can be circulated in the wellbore or well annulus of well 140. As for well 140, drop balls can be delivered into ball drop system 146 to pressure up and set open hole packers 148, similar to installation in well 130. Well 140 can now be ready for further operation such as fracturing.

A tie back string (not shown) can be next run in hole and the drilling rig 110 can be moved off the surface drilling pad. The fracturing equipment and crew can be moved in to perform fracturing through well 140 shown in FIG. 2H, as can be understood by those skilled in the art. For example, as is conventional, well 140 can be operated in stages from well toe to well heel for the fracturing operation. While FIG. 2H depicts injection of fluids at different ports in the same figure, it should be understood that different injection points in ball drop system 146 can be activated sequentially from toe to heel by dropping sequentially larger and larger drop balls into ball drop system 146, to sequentially shifting the fracture sleeve 149 in each stage of ball drop system 146 to open the injection port in that stage.

Further, when different liner systems or injection systems are used in place of the ball drop systems, a fluid injection operation or fracturing operation can be carried out in a different manner and in accordance with practice appropriate for such systems, as known to those skilled in the art.

After a phase of fracturing through well 140 is completed, mating tool 400 can be shifted by delivering a drop ball 500 (see FIGS. 4D and 4F, for example) into the ball drop sub 406 of mating tool 400 to block off the fluid path to well 140, and open up the fluid path to well 130. Details of the operation of the ball drop sub 406 of mating tool 400 will be described further below.

Figure 2I:
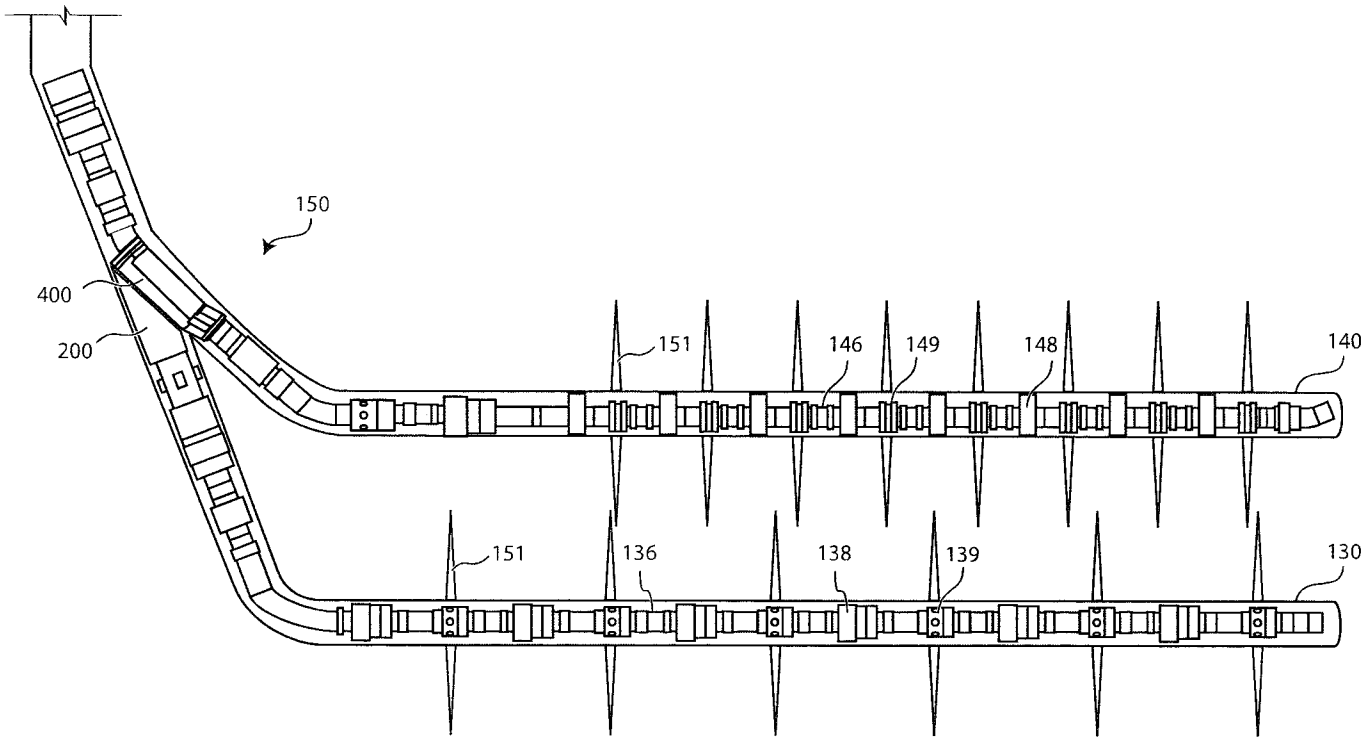

Next, the fracturing fluid and drop balls are applied to ball drop system 136 in well 130 to fracture through well 130, as illustrated in FIG. 2I. As can be appreciated, the fracturing operations can be similarly carried out through wells 130 and 140.

After both wells 130 and 140 have been subjected to fracturing operations, wells 130 and 140 can be opened for normal operation, such as oil production or gas production. For example, oil production can be carried out using any suitable in situ oil extraction techniques, including enhanced oil recovery (EOR) processes such as steam-assisted gravity drainage (SAGD), solvent assisted recovery processes, or the like.

Conveniently, multiple lateral wells can be drilled and fractured with a single mobilization of the fracturing equipment and crew.

As can be appreciated, two or more lateral sections or wells can be drilled, for example three, four, five, six, seven, eight, nine or ten lateral sections or wells, using a similar process with some modification. The different lateral sections or wells can be drilled at different depths and extending into different directions from the main well.

When more than two lateral wells are desired, the multiple lateral wells can be drilled and completed one after another, similar to the process described above with a whipstock assembly set at each junction. The fracturing equipment and crew can be moved in after all desired lateral wells have been drilled and completed.

To briefly recap, in a process according to a selected embodiment of the present disclosure, a lower wellbore is first drilled, and a completion system, for example, a multistage ball drop system is installed in the lower wellbore. A whipstock as described herein is installed at a desired position in the main well or a vertical or inclined section of the first well. An upper lateral wellbore is drilled off the whipstock, which can be carried out in a conventional manner. After the upper lateral wellbore has been drilled, the core of the whipstock is removed with a pulling tool. A completion system, for example, a multistage ball drop system is next installed in the upper lateral wellbore, and a mating tool is engaged with the whipstock. At this time, the drill rig/crew can be replaced with the fracturing equipment/crew at surface. The upper lateral well is fractured first. A drop ball is then dropped to shift the mating tool to open the passageway to the lower wellbore. The lower wellbore is next fractured. As a result, only a single mobilization of the fracturing equipment/crew is required.

The whipstock has a removable core which initially, in one embodiment, is held in place with shear pins. An engagement mechanism is provided on the removable core for removing the core with a pulling tool. The removable core can function as a plug, in that it initially blocks communication to the lower wellbore(s), but when it is removed, a passageway through the whipstock is provided for communication with the lower wellbore(s). The whipstock also has rail guides on its top portion for engaging rails on the mating tool. The face of the whipstock and the mating tool, in some embodiments, have corresponding seal areas, so that when the whipstock and the mating tool are engaged, the seal areas are sealed to prevent pressure or fluid communication. The mating tool has a flow control mechanism for selective communication with the upper or lower wellbore, which, in some embodiments, includes a ball drop sub that is initially open to the upper wellbore but can be shifted with a drop ball to close the passageway to the upper wellbore and open the passageway to the lower wellbore.

Details of selected embodiments of the whipstock and mating tool assembly, which can be collectively referred to as a junction creation tool, are described next for illustration purposes.

As depicted in FIGS. 3A, 3B, 3C, 3D, 3E, 3F, 3G, 3H, 3I, 3J, 3K, 3L and 3M, an example embodiment of whipstock 200 has a body 220, which has walls that define a channel 222 within the body 220. A removable core 204 is initially received in channel 222 and is secured in place by one or more shear pins 206. The work face 202 of whipstock 200 is provided on core 204. A keyway 208 can be provided on core 204 for engaging the core 204 with a hook on a pulling tool (not shown) as can be understood by those skilled in the art. Rail guides 210 are provided on body 220, as well as deadstop 218.

As illustrated in FIGS. 3A and 3B, channel 222 is initially plugged by core 204 when core 204 is positioned in place in whipstock 200. When core 204 is removed from whipstock body 220, as illustrated in FIG. 3B, channel 222 is "unplugged" and a passageway through whipstock body 220 is provided by channel 222, which allows fluids and drop balls to pass through whipstock body 220.

FIG. 3C shows a schematic top view of the work face 202 of whipstock 200 with the core 204 in place. FIG. 3F shows a schematic top view of whipstock 200 and channel 222, without core 204.

As better illustrated in FIGS. 3K to 3M and FIGS. 5F and 5H, whipstock 200 also includes a piston 212, a protective sleeve 214, and a seal element 216. Piston 212 can be shifted by application of internal tubing hydraulic pressure (HP) to move axially upstream, and to press seal element 216 against a side of mating tool 400. Piston 212 can be locked with a locking ring 224 (see FIG. 3M).

Figure 3J:
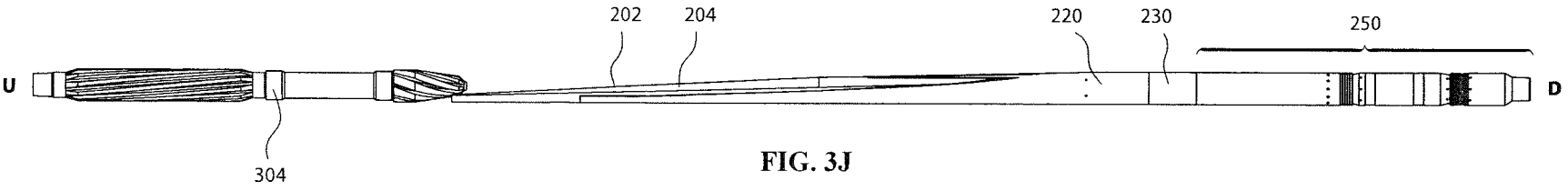
FIGS. 3J and 3K are plan and cross-section views, respectively, of the whipstock of FIG. 3A attached to anchor and packer subassemblies.
Figure 3K:
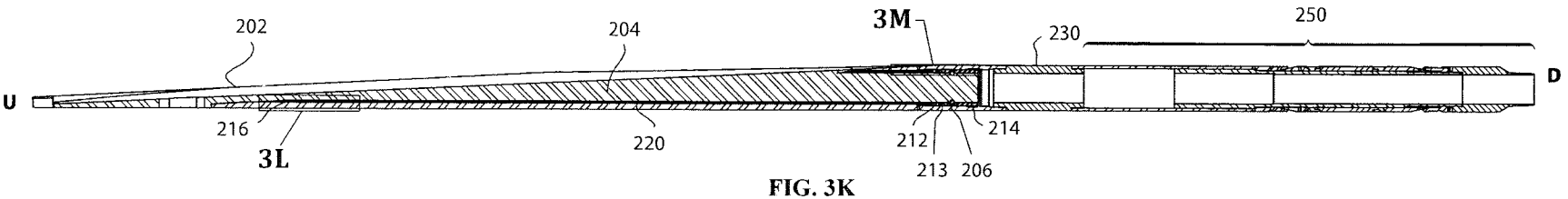
Figure 3L:
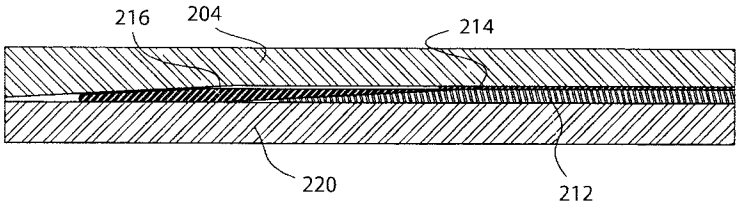
FIGS. 3L and 3M are enlarged cross-sectional views of the areas marked 3L and 3M, respectively, in FIG. 3K.
Figure 3M:
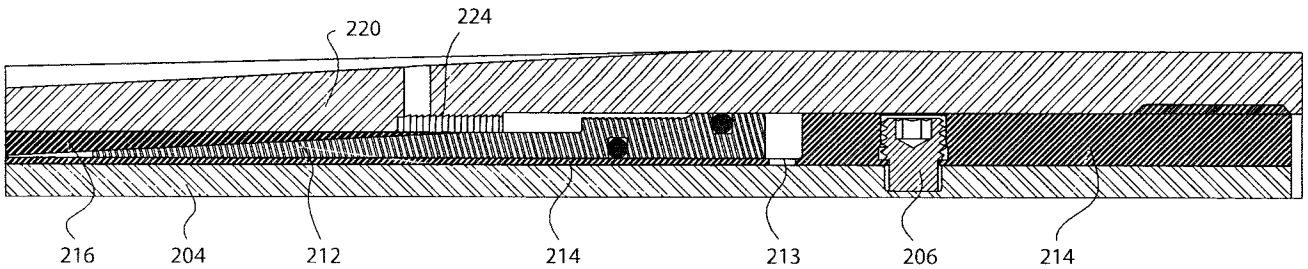

As illustrated in FIGS. 3J and 3K, whipstock body 220 may be supported on an anchor crossover 230, which is in turn supported on a packer sub 250.

As depicted in FIGS. 4A, 4B, 4C, 4D, 4E and 4F an example embodiment of mating tool 400 has a shifting sleeve 402, and also includes a top junction sub 404, a ball drop sub 406, a rail sub 408, an exterior seal sub 410, a bottom fin sub 412, a bottom junction sub 414, a clutching ring 416, a ball seat 418, a clutch 420, and a port 422 for fluid communication with the channel 222 in the whipstock 200.

A drop ball 500 can be used to actuate shifting sleeve 402 inside mating tool 400. The drop ball 500 can seat on the ball seat 418 inside the shifting sleeve 402 and allow for a differential pressure to be developed and applied. When the shifting sleeve 402 in mating tool 400 shifts from a closed (upstream, U) position to an open (downstream, D) position, a differential pressure can be created inside whipstock 200 as will be further described below. As used herein, "upstream" refers to the direction towards the wellhead in the well axial direction.

As better seen in FIGS. 4C, 4D, 4E and 4F during use, the shifting sleeve 402 can be initially in an upstream, closed position so that fluid can pass through bottom junction sub 414, but is blocked by shifting sleeve 402 from entering into port 422 leading to the whipstock 200. When a drop ball 500 is delivered into mating tool 400, the drop ball 500 sits in ball seat 418 and is forced by the fluid pressure to move the ball seat 418 and shifting sleeve 402 with it towards bottom junction sub 414 until the clutch 420 is stopped at and engaged with clutch ring 416. At this position, drop ball 500 blocks fluid communication through bottom junction sub 414. However, as shifting sleeve 402 is moved away from port 422 fluid communication path to whipstock 200 is now open.

Figure 5A:
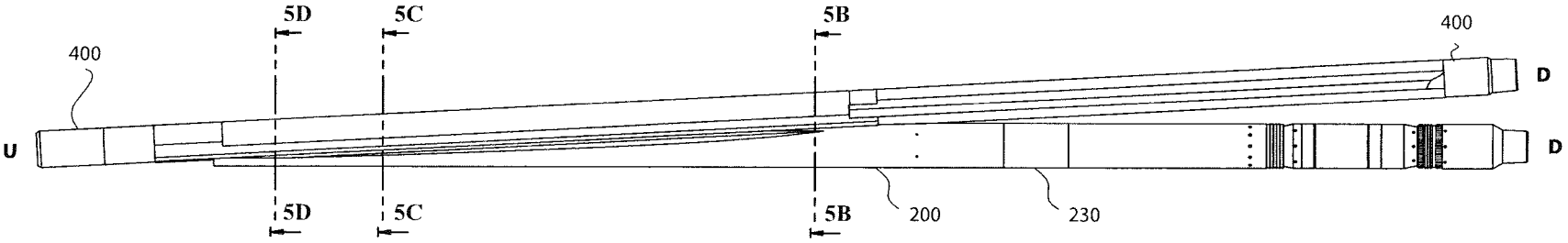
FIG. 5A is a side elevation view of the whipstock of FIG. 3L engaged with the mating tool of FIG. 4A.
Figure 5B:
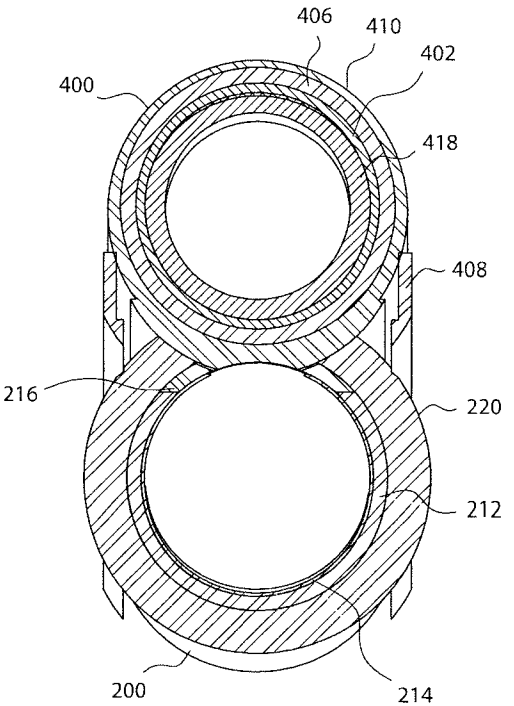
FIGS. 5B, 5C and 5D are enlarged cross-sectional views of the whipstock and mating tool of FIG. 5A, taken along the lines 5B-5B, 5C-5C, and 5D-5D, respectively.
Figure 5C:
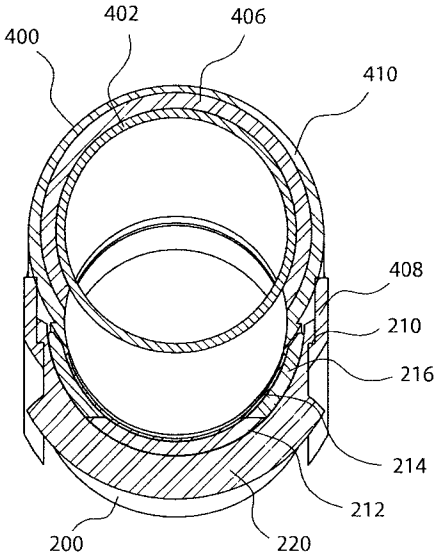
Figure 5D:
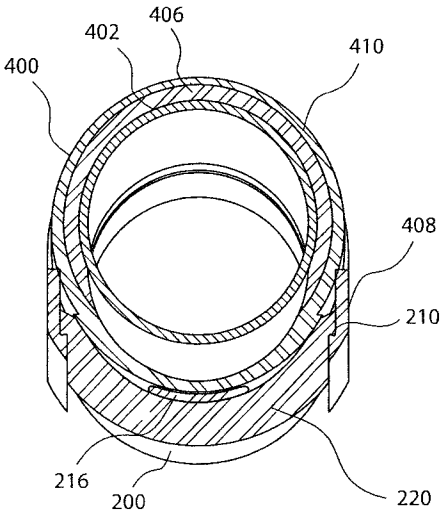

The engagement and operation of mating tool 400 and whipstock 200 are further illustrated in FIGS. 5A, 5B, 5C, 5D, 5E, 5F, 5G, and 5H where the thick dark arrows within the mating tool 400 indicate fluid flow path. FIGS. 5A to 5D illustrate engagement of whipstock 200 with mating tool 400. FIG. 5B shows a cross-sectional view of whipstock 200 engaged with mating tool 400, taken along line 5B-5B in FIG. 5A. FIGS. 5C and 5D show cross-sectional views taken along lines 5C-5C and 5D-5D in FIG. 5A, respectively. FIG. 5C also shows the engagement of rails 408*a* with rail guides 210.

Figure 5E:
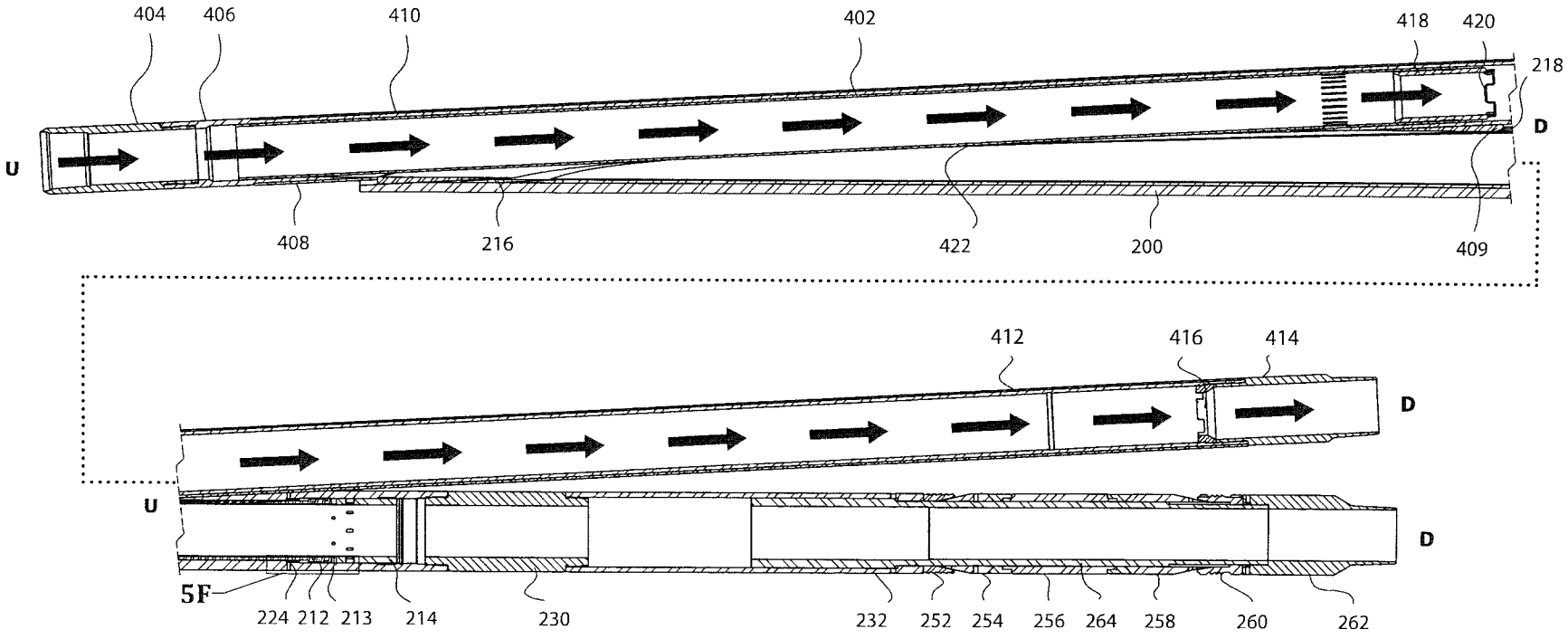
FIGS. 5E and 5G are broken cross-sectional views of the engaged whipstock and mating tool shown in FIG. 5A, at different stages of operation.
Figure 5F:
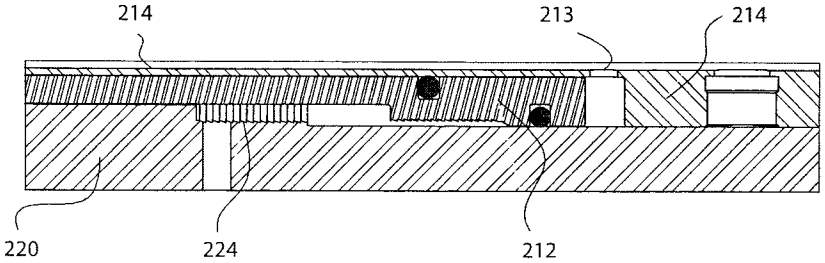
FIGS. 5F and 5H are enlarged cross-sectional views of the areas marked 5F and 5H in FIGS. 5E and 5G, respectively.
Figure 5G:
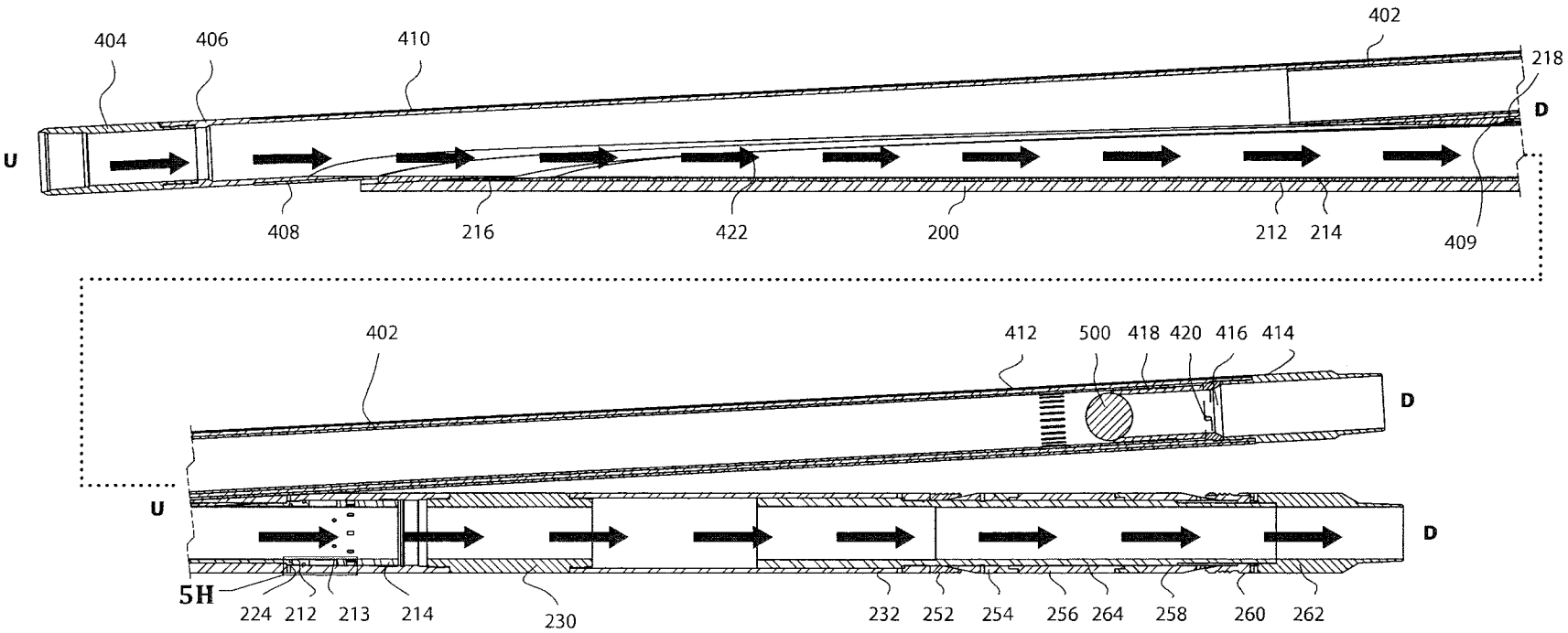
Figure 5H:
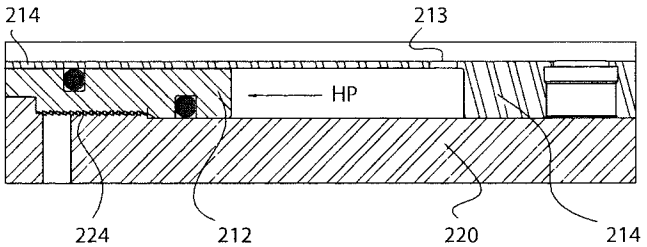

FIGS. 5E and 5F show the mating tool 400 in the closed configuration where the fluid flow path is from top junction sub 404 towards bottom junction sub 414, and fluid flow to whipstock 200 is blocked. FIGS. 5G and 5H show the mating tool 400 in the open configuration where the fluid flow path is from top junction sub 404 to channel 222 of whipstock 200, and fluid flow towards bottom junction sub 414 is blocked by drop ball 500 at ball seat 418. Furthermore, the impact face 409 of mating tool 400 is shown in contact with deadstop 218 of whipstock 200 (see: FIGS. 5E, 5H). The dotted lines in FIGS. 5E and 5G are meant to connect the portions of the mating tool 400 and whipstock 200 that are shown in dashed broken lines.

It can thus be appreciated that when port 422 in mating tool 400 is opened by shifting sleeve 402 with a drop ball 500, a pressure differential is created, which will cause fluid to flow through internal port 213 in whipstock 200 to push the piston sleeve 212 upstream and actuate a mechanical seal against the outside surface of mating tool 400. The drop ball 500 that is sitting in ball seat 418 will stay in ball seat 418, and hydraulically isolate well 140 from well 130 and the main wellbore 150. Piston sleeve 212 and seal element 216 of whipstock 120 hydraulically isolate the internal fluid path inside the junction tool from the reservoir formation. The sealing can prevent unintended fluid flow into the formation and unintended fracture of the formation. In other words, top junction sub 404 may be considered as an input or input port, bottom junction sub 414 may be considered as a first output port and the port 422 to the whipstock 200 may be considered as a second output port. The valve configuration with the shifting sleeve 402 in mating tool 400 can selectively direct fluid flow from the input port to the first output port or to the second output port. The drop ball 500 sitting in the ball seat 418 isolates the input port from the first output port.

Figure 6:
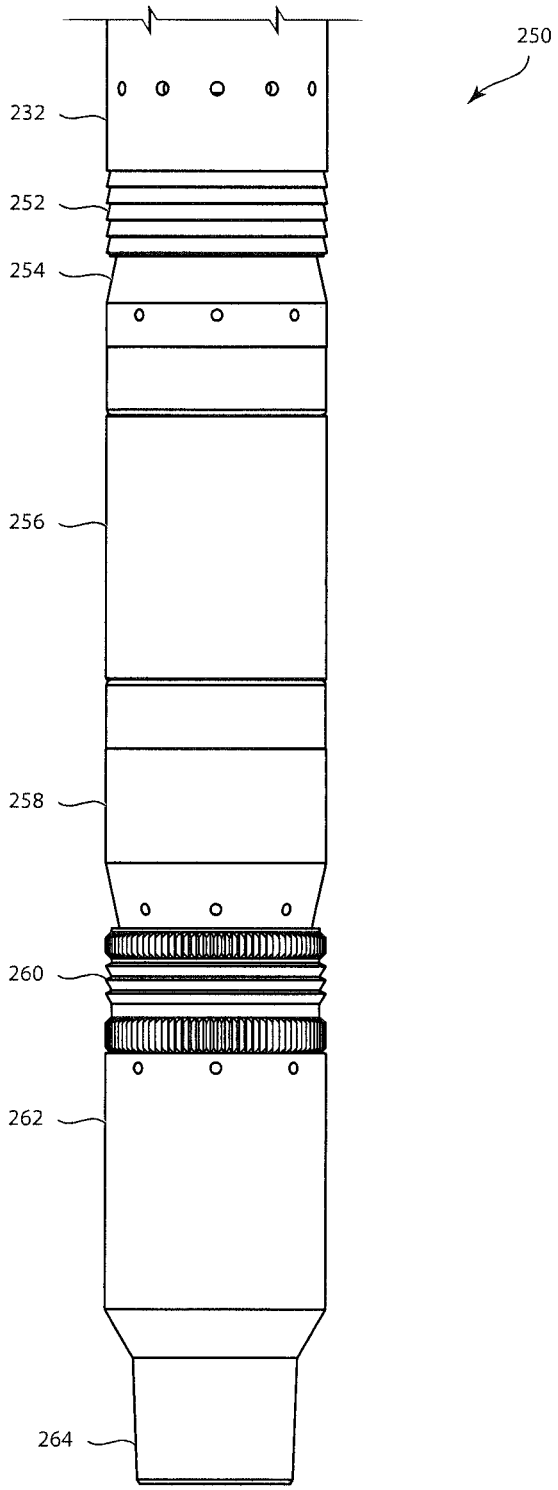
FIG. 6 is a side elevation view of a packer sub for supporting the whipstock of FIG. 3A.

As depicted in FIG. 6, packer sub 250 comprises an anchor sub 232, upper slips 252, upper wedge 254, packer element 256 (also referred to as element stack), lower wedge 258, tri-directional slips 260, anchor bottom sub 262, and anchor mandrel 264. Slips 252 can anchor whipstock 200 in place to prevent it from turning or moving, so whipstock 200 is affixed relative to the window to be milled off whipstock 200. Element 256 blocks fluid flow downward into well 130. When the fluid path is hydraulically sealed, it is more difficult for debris to fall into the fluid path. As can be appreciated, debris in the fluid path or in the tubing can impair retrieval of whipstock core 204.

Figure 7:
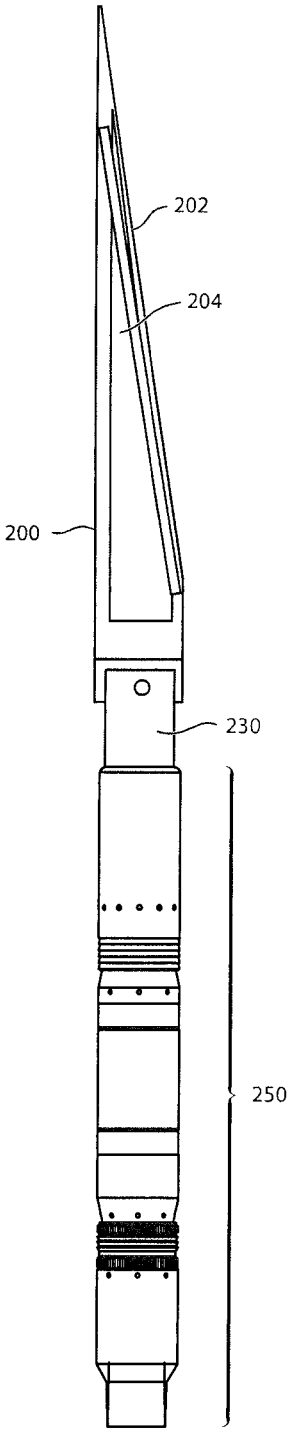
FIG. 7 is a side elevation view of the whipstock of FIG. 3A engaged with the packer sub of FIG. 6.

During use, whipstock 200, anchor crossover 230 and packer sub 250 are assembled and engaged as illustrated in FIG. 7, and can be so assembled downhole.

As can be appreciated, the combination of whipstock 200, mating tool 400 and optionally packer sub 250, provides a tool assembly or junction creation tool for convenient use in the process described with reference to FIGS. 2A to 2I. This tool assembly and process can allow multiple lateral wells to be drilled with a single mobilization of a drilling rig and then completed with a single mobilization of a fracturing equipment/crew, and without the need for a service rig during the completion phase.

In an embodiment, a junction creation tool includes a whipstock with a removable core which provides the work face for the whipstock. The whipstock has rail guides that are exposed after the core has been removed, and has a seal system inside the whipstock body. The removal of the core allows for a passageway through the whipstock body to be exposed for fluid passage therethrough. The junction creation tool also includes a mating tool, which has rails that match and can engage the rail guides on the whipstock body, and is adapted and configured to hydraulically seal the contact surfaces between the mating tool and the whipstock. Further, the mating tool includes a ball-actuated flow control mechanism to selectively direct fluid flow to the passageway in the whipstock or to another fluid passageway.

In different embodiments, a ball-actuated valve described above for controlling fluid flow can be replaced with another actuation or shifting device for moving a control sleeve.

In one embodiment, the shifting device is a bridge plug wherein the valve is configured to receive the bridge plug. The bridge plug can be operable, for example, by a wireline, a slickline, a coiled tubing or a rig. The bridge plug, in one embodiment, is a retrievable bridge plug, for example, a bridge plug similar to bridge plugs commonly used in fracturing operations with coiled tubing in a cemented liner completion. The bridge plug further can be a wireline bridge plug disposed in a valve sleeve and actuated by fluid pressure.

In one embodiment, the shifting device is a mechanical shifting tool, wherein the valve is configured to receive the mechanical shifting tool. The shifting tool can be operable, for example by a wireline, a slickline, a coiled tubing or a rig. The mechanical shifting tool, in one embodiment, includes, for example, a mechanical packer similar to mechanical packers commonly used in fracturing operations with coiled tubing in a cemented liner completion.

In one embodiment, the shifting device is a control line, wherein the valve is configured to receive the control line. The control line can be operable, for example by a wireline, a slickline, a coiled tubing or a rig.

In one embodiment, fluid flow at a well junction can also be controlled by using a coiled tubing unit or service rig to run a tubing shifting tool in the hole, as can be understood by those skilled in the art.

It can understood that in a process of operating wells using a whipstock assembly described herein, the wells can be used to otherwise stimulate the formation instead of, or in addition to, fracturing the formation. For example, a stimulation fluid can be injected into each one of the wells above and below the whipstock at a pressure sufficient to stimulate a portion of the reservoir around each well.

It can also be understood by those skilled in the art that, a whipstock as described herein can be set into a well that is substantially vertical, or a well that has a substantially vertical section and a substantially horizontal section, to drill another well section from the initial wellbore. The junction at which the whipstock is anchored can be located in a vertical section or an inclined section of the initial well. The initial well, and any well drilled off from the initial well can be drilled by directional drilling.

As now can be appreciated, a whipstock assembly described herein can be conveniently used to drill and operate branched wells including multilateral wells with reduced change-over of surface service crews or equipment. It can be applied in various oil or gas extraction processes.

Of course, the above described example embodiments of the present application are intended to be illustrative only and in no way limiting. The described embodiments are susceptible to many modifications of form, arrangement of parts, details and order of operation. The invention, rather, is intended to encompass all such modifications within its scope, as defined by the claims, which should be given a broad interpretation consistent with the description as a whole.

What is claimed is:

1. A downhole tool assembly for operating a branched well, the assembly comprising:

a whipstock having a whipstock body, the whipstock body having a longitudinal channel, defined therethrough and an angled work face;

a mating tool positionable within a branched well and couplable to the whipstock body along the angled work face thereof at a junction;

a flow control valve configured to cooperate with the whipstock body and the mating tool to selectively direct fluid flow to the branched well or to the channel of the whipstock body; the flow control valve including a valve sleeve arranged within the mating tool and capable of displacement therein between an upstream position adjacent the junction and a downstream position located away from the junction, and a removable sleeve shifting device capable of obstructing a flow passageway defined in the valve sleeve and cooperating with the valve sleeve to urge displacement of the valve sleeve within the mating tool;

when the valve sleeve is in the upstream position, the valve sleeve extends across the work face and blocks fluid communication with the channel of the whipstock body; and the flow passageway defined within the valve sleeve remains free from any obstruction formed by the shifting device.

2. The downhole tool assembly of claim 1 wherein, when the flow control valve is in the downstream position, the flow passageway defined within the valve sleeve is obstructed.

3. The downhole tool assembly of claim 1 wherein, the flow control valve is one of a hydraulically-actuated valve and a mechanically-actuated valve.

4. The downhole tool assembly of claim 1, wherein:

the mating tool includes an input port, first output port and a second output port; the second output port being configured for fluid communication between the mating tool and the channel of the whipstock body when the mating tool is coupled to the whipstock body;

when in the upstream position, the valve sleeve obstructs the second output port thereby preventing the flow of fluid into the channel of the whipstock body and allowing the fluid to flow from the input port to the first output port;

when in the downstream position, the valve sleeve is clear of the second output port so as to allow the flow of fluid from the input port to the second output port.

5. The downhole tool assembly of claim 4, wherein:

the whipstock body has an internal port;

when the mating tool is coupled to the whipstock body, the internal port of the whipstock body is aligned with the second output port of the mating tool;

when the valve sleeve is moved to the upstream position, a portion of the valve sleeve occludes the second output port to prevent fluid communication between the second output port and the internal port of the whipstock body.

6. The downhole tool assembly of claim 1, wherein the flow control valve is ball-actuated.

7. The downhole tool, assembly of claim 1 wherein:

the sleeve shifting device is a drop ball;

the valve sleeve includes a ball seat defiled therein for receiving the drop ball; and when the mating tool is coupled to the whipstock body, the flow control valve is configured to be actuated to flow fluid into the channel of the whipstock body by causing the drop ball to be seated within the ball seat.

8. The downhole tool assembly of claim 7, wherein:

the mating tool includes an input port, a first output port and a second output port;

the second output port being configured for fluid communication between the mating tool and the channel of the whipstock body when the mating tool is coupled to the whipstock body;

when the valve sleeve is in the downstream position, fluid communication is established between the input port and the first output port; and the drop ball is seated within the ball seat defined in the valve sleeve; and the input port is hydraulically isolated from the second output port.

9. The downhole tool assembly of claim 1, wherein the sleeve shifting device is one of a bridge plug, a control line, and a shifting tool.

10. The downhole tool assembly of claim 9, wherein the sleeve shifting device is positionable relative to the valve sleeve using one of a wireline, a slickline, and a coiled tubing and a rig.

11. The downhole tool assembly of claim 1 further comprising, a sealing mechanism associated with the whipstock; the sealing mechanism being configured to seal an outside surface of the mating tool adjacent the work face of the whipstock body, when the mating tool is coupled to the whipstock body and the flow control valve is actuated to direct fluid flow to the channel of the whipstock body.

12. The downhole tool assembly of claim 11, wherein:

the sealing mechanism includes a sealing element and a piston sleeve; and the piston sleeve is operable to move in response to the application of pressure so as to cause the sealing, element to sealingly engage the outside surface of the mating tool.

13. The downhole tool assembly of claim 12, wherein the sealing element further includes a locking ring for fixing the piston sleeve in position.

14. The downhole tool assembly of claim 12, wherein the sealing mechanism further includes a protective sleeve.

15. The downhole tool assembly of claim 12, wherein the piston sleeve is moveable within the whipstock body between a sealing position and a non-sealing position; the sealing position being upstream of the non-sealing position.

16. The downhole tool assembly of claim 11, wherein the sealing mechanism is pressure actuated.

17. The downhole tool assembly of claim 16, wherein the sealing mechanism is actuated by differential pressure created inside the whipstock when the flow control valve is actuated to direct fluid flow to the channel of the whipstock body.

18. The downhole tool assembly of claim 1, wherein the whipstock body includes a groove defined therein and the mating tool includes a rail; the rail being configured for mating engagement with the groove to allow coupling of the mating tool with the whipstock body.

19. The downhole tool assembly of claim 1, wherein:

the whipstock body includes rail guides disposed adjacent the angled work face; and the mating tool has rails for sliding engagement with the rail guides of the whipstock body when the mating tool is coupled to the whipstock body.

20. The downhole tool assembly of claim 1 further comprising a core removably mountable within the channel, the core having a work face for orienting a drill; when the core is mounted within the channel, the assembly is configured to permit the drill to drill the branched well.

21. The downhole tool assembly of claim 20 wherein, the whipstock body includes a groove defined therein and the mating tool includes a rail; the rail being configured for mating engagement with the groove to allow coupling of the mating tool with the whipstock body; when the core is mounted within the channel of the whipstock body, the groove is covered by the core.

22. The downhole tool assembly of claim 20, wherein:

when the core is secured in place within the channel of the whipstock body by a pin received in a pin hole formed in the whipstock body; and the core is configured to be released from the channel by breaking the pin by the application of a shearing force.

23. A process for selectively directing flow through a main wellbore or an associated branched well using a downhole tool assembly, the downhole tool assembly including a whipstock having a whipstock body and a longitudinal channel defined therethrough, a mating tool positioned within the branched well and coupled to the whipstock body along an angled work face of the whipstock body at a junction, and a flow control valve configured to cooperate with the whipstock body and the mating tool to selectively direct fluid flow to the branched well or to the channel of the whipstock body; the flow control valve including a valve sleeve arranged within the mating tool and a removable sleeve shifting device capable of obstructing a flow passageway defined in the valve sleeve and cooperating with the valve sleeve to urge displacement of the valve sleeve within the mating tool, the process comprising:

urging the valve sleeve to move within the mating tool between an upstream position adjacent the junction and a downstream position located away from the junction;

when the flow control valve is in the upstream position, the valve sleeve extends across the work face and blocks fluid communication with the channel of the whipstock body;

the flow passageway defined within the valve sleeve remains free from any obstruction formed by the shifting device; and when the flow control valve is in the downstream position, the flow passageway defined within the valve sleeve is obstructed.

24. The process of claim 23, further comprising sealing, an outside surface of the mating tool adjacent the work face of the whipstock body, when the mating tool is coupled to the whipstock body and the valve sleeve occupies the downstream position.

25. The process of claim 24, wherein sealing the outside surface of the mating tool includes urging a piston sleeve associated with the whipstock body to move in response to the application of pressure and to bear against a sealing element so as to cause the sealing element to sealingly engage the outside surface of the mating tool.

26. The process of claim 25, further including locking the piston sleeve in position.

27. The process of claim 25 wherein urging the piston sleeve to move includes moving the piston sleeve within the whipstock body from a non-sealing position to a sealing position;

the sealing position being upstream of the non-sealing position.

28. A process for deploying a mating tool within a branched well associated with a main wellbore, the main wellbore having arranged therein a whipstock having a whipstock body and a longitudinal channel defined therethrough, the process comprising:

providing a flow control valve configured to cooperate with the whipstock body and the mating tool to selectively direct fluid flow to the branched well or to the channel of the whipstock body; the flow control valve including a valve sleeve arranged within the mating tool and capable of displacement therein between an upstream position adjacent a junction between the mating tool and the whipstock body and a downstream position located away from the junction, the valve sleeve being engageable with a removable sleeve shifting device capable of obstructing a flow passageway defined in the valve sleeve and cooperating with the valve sleeve to urge displacement of the valve sleeve within the mating tool; when the flow control valve is in the upstream position, the flow control valve being operable to:

cause the valve sleeve to extend across the work face and blocks fluid communication with the channel of the whipstock body; and cause the flow passageway defined within the valve sleeve to remain free from any obstruction formed by the shifting device;

positioning the mating tool within the branched well; and coupling the mating tool to the whipstock body along an angled work face of the whipstock body at the junction.

29. The process of claim 28 wherein the step of coupling includes slidingly engaging rails provided on the mating tool with rail guides provided on the whipstock body.

* * * * *